US008183524B2

(12) United States Patent
Kenny et al.

(10) Patent No.: US 8,183,524 B2
(45) Date of Patent: May 22, 2012

(54) MASS SPECTROMETER HAVING TIME OF FLIGHT MASS ANALYSER

(75) Inventors: Daniel James Kenny, Knutsford (GB); Jason Lee Wildgoose, Stockport (GB); Martin Green, Cheshire (GB)

(73) Assignee: Micromass UK Limited, Manchester (GB)

( * ) Notice: Subject to any disclaimer, the term of this patent is extended or adjusted under 35 U.S.C. 154(b) by 76 days.

(21) Appl. No.: 12/516,610

(22) PCT Filed: Dec. 14, 2007

(86) PCT No.: PCT/GB2007/004820

§ 371 (c)(1),
(2), (4) Date: Jan. 25, 2010

(87) PCT Pub. No.: WO2008/071993

PCT Pub. Date: Jun. 19, 2008

(65) Prior Publication Data

US 2010/0148056 A1 Jun. 17, 2010

Related U.S. Application Data

(60) Provisional application No. 60/884,509, filed on Jan. 11, 2007.

(30) Foreign Application Priority Data

Dec. 14, 2006 (GB) ..... 0624993.2

(51) Int. Cl.
*H01J 49/00* (2006.01)

(52) U.S. Cl. ..... 250/287; 250/281; 250/282; 250/286

(58) Field of Classification Search ..... 250/281, 250/287

See application file for complete search history.

(56) References Cited

U.S. PATENT DOCUMENTS

| | | | | |
|---|---|---|---|---|
| 5,650,617 | A * | 7/1997 | Mordehai | 250/290 |
| 5,689,111 | A | 11/1997 | Dresch et al. | |
| 6,455,845 | B1 * | 9/2002 | Li et al. | 250/287 |
| 6,642,514 | B2 * | 11/2003 | Bateman et al. | 250/288 |
| 6,770,872 | B2 * | 8/2004 | Bateman et al. | 250/281 |
| 7,309,861 | B2 * | 12/2007 | Brown et al. | 250/290 |
| 2001/0030284 | A1 * | 10/2001 | Dresch et al. | 250/287 |
| 2002/0100870 | A1 * | 8/2002 | Whitehouse et al. | 250/281 |
| 2003/0001087 | A1 * | 1/2003 | Fuhrer et al. | 250/287 |
| 2003/0066958 | A1 * | 4/2003 | Okumura et al. | 250/286 |
| 2004/0026613 | A1 * | 2/2004 | Bateman et al. | 250/281 |
| 2004/0119012 | A1 * | 6/2004 | Vestal | 250/287 |
| 2005/0001163 | A1 * | 1/2005 | Belov et al. | 250/290 |
| 2005/0139760 | A1 * | 6/2005 | Wang et al. | 250/281 |
| 2010/0148056 | A1 * | 6/2010 | Kenny et al. | 250/282 |
| 2011/0155901 | A1 * | 6/2011 | Vestal | 250/282 |

FOREIGN PATENT DOCUMENTS

| | | |
|---|---|---|
| EP | 1302973 | 12/2006 |
| GB | 2391697 | 2/2004 |
| GB | 2409764 | 7/2005 |
| WO | 2005/043575 | 5/2005 |
| WO | WO 2006048642 A2 * | 5/2006 |

* cited by examiner

*Primary Examiner* — Jack Berman
*Assistant Examiner* — Jason McCormack
(74) *Attorney, Agent, or Firm* — Diederiks & Whitelaw PLC

(57) ABSTRACT

A mass spectrometer is disclosed comprising an orthogonal acceleration Time of Flight mass analyser. A pulse or packet of ions is released either from an ion trap or alternatively from a travelling wave ion guide arranged upstream of an orthogonal acceleration electrode which forms part of the Time of Flight mass analyser. Ions in the pulse or packet or ions which is released become temporally dispersed and the orthogonal acceleration electrode is energized multiple times prior the release of a subsequent pulse or packet of ions.

16 Claims, 10 Drawing Sheets

MASS SPECTROMETER HAVING TIME OF FLIGHT MASS ANALYSER

CROSS REFERENCE TO RELATED APPLICATIONS

This application is the National Stage of International Application No. PCT/GB2007/004820, filed Dec. 14, 2007, which claims priority to and benefit of U.S. Provisional Patent Application Ser. No. 60/884,509, filed Jan. 11, 2007, and United Kingdom Patent Application No. 0624993.2, filed Dec. 14, 2006. The entire contents of these applications are incorporated herein by reference.

BACKGROUND OF THE INVENTION

The present invention relates to a mass spectrometer and a method of mass spectrometry. The preferred embodiment relates to a method of enhancing the duty cycle of an orthogonal acceleration Time of Flight mass analyser.

In a conventional orthogonal acceleration Time of Flight mass analyser ions having approximately the same energy are arranged to be passed through an orthogonal acceleration region. An orthogonal acceleration electric field is periodically applied across the orthogonal acceleration region in order to orthogonally accelerate ions into the drift region of the Time of Flight mass analyser. The length of the region over which the orthogonal acceleration electric field is applied, the energy of the ions and the frequency of the application of the orthogonal acceleration electric field determine the sampling duty cycle of the Time of Flight mass analyser. Ions which have approximately the same energy but different mass to charge ratios will have different velocities and hence will have different sampling duty cycles.

The maximum ion sampling duty cycle for a conventional orthogonal acceleration Time of Flight mass analyser when used with a continuous ion beam is typically approximately 20-25%. The maximum duty cycle is achieved for those ions which have the maximum mass to charge ratio which are mass analysed by the mass analyser. The ion sampling duty cycle is lower for ions having relatively low mass to charge ratios.

If ions having the maximum mass to charge ratio which can be mass analysed by the mass analyser have a mass to charge ratio $m_o$ and the sampling duty cycle for these ions is $DC_o$ then more generally the sampling duty cycle DC for ions having a mass to charge ratio m is given by:

$$DC = DC_0\sqrt{\frac{m}{m_0}} \tag{1}$$

It can be shown that the average sampling duty cycle $DCa_v$ is equal to two thirds of the maximum sampling duty cycle $DC_0$. Accordingly, if the maximum sampling duty cycle is 22.5% then the average sampling duty cycle is 15%.

It is known to attempt to improve the duty cycle just for ions having a relatively narrow range of mass to charge ratios by trapping and releasing ions from an ion storage device which is arranged upstream of the Time of Flight mass analyser. An orthogonal acceleration pulse is timed to coincide with the arrival of ions of interest at an orthogonal acceleration region adjacent the orthogonal acceleration electrode. If ions are stored in an ion trap upstream of the orthogonal acceleration Time of Flight mass analyser and are released in a series of packets rather than allowed to flow continuously, then the application of a pusher voltage to the orthogonal acceleration electrode can be synchronised with respect to the release of each packet of ions from the ion trap. According to this arrangement ions are arranged to be released from the ion trap with substantially constant energy. Ions having different mass to charge ratios will therefore travel towards the orthogonal acceleration region with different velocities. As a result, ions having different mass to charge ratios will arrive at the orthogonal acceleration region at different times. The time delay between the release of a packet of ions from the ion trap to the application of the pusher voltage to the orthogonal acceleration electrode determines the mass to charge ratio of the ions that are transmitted into the drift region of the orthogonal acceleration Time of Flight mass analyser. For those ions having a narrow range of mass to charge ratios which are transmitted into the draft region of the orthogonal acceleration Time of Flight mass analyser, the duty cycle can be increased to substantially 100%. However, the majority of other ions having other mass to charge ratios will not lie fully in the orthogonal acceleration region at the time when the pusher voltage is applied to the pusher electrode. Accordingly, all other ions will have substantially lower sampling efficiencies and ions having mass to charge ratios which are removed from those ions which are orthogonally accelerated will have a sampling efficiency of zero.

It is also known to attempt to increase the duty cycle of a Time of Flight mass analyser for ions having a limited range of mass to charge ratios by providing a travelling wave ion guide upstream of a mass analyser. The orthogonal acceleration voltage is sychronised with packets of ions released from the travelling wave ion guide. The ion guide is arranged to partition a continuous stream of ions into a series of packets of ions. The time delay between the release of a packet of ions from the exit region of the travelling wave ion guide to the application of a pusher voltage determines the mass to charge ratio range of ions which are transmitted into the drift region of the orthogonal acceleration Time of Flight mass analyser. For those ions that are transmitted the duty cycle can be increased to substantially 100%. However, ions having other mass to charge ratios will not all be present in the orthogonal acceleration region at the time when the pusher voltage is applied to the orthogonal acceleration electrode. Accordingly, the sampling efficiency for these ions will be lower and may be zero.

It is desired to provide an improved mass spectrometer and method of mass spectrometry.

SUMMARY OF THE INVENTION

According to an aspect of the present invention there is provided a Time of Flight mass analyser comprising an orthogonal acceleration electrode and a drift region;

wherein, in use, a first pulse or packet of ions is released at a first release time T1;

wherein the mass analyser further comprises a control device which is arranged and adapted:

(i) to energise the orthogonal acceleration electrode a first time after a first delay time $\Delta t_{1-1}$ from the first release time T1 and prior to the release of a second pulse or packet of ions at a second release time T2; and (ii) to energise the orthogonal acceleration electrode at least a second subsequent time after a second delay time $\Delta t_{1-2}$ from the first release time T1 and prior to the release of a second pulse or packet of ions at a second release time T2.

The first and/or second pulse or packet of ions may according to one embodiment be released from an ion trap, ion trapping region or ion gate upstream of the Time of Flight mass analyser.

According to an embodiment, second and/or third and/or fourth and/or fifth and/or sixth and/or seventh and/or eighth and/or ninth and/or tenth and/or further pulses or packets of ions are released from the ion trap, ion trapping region of ion gate.

According to another embodiment the first and/or second pulse or packet of ions may be released from an ion guide which is preferably arranged upstream of the Time of Flight mass analyser. According to this embodiment the ion guide preferably partitions a continuous ion beam into a series of packets of ions. Each packet of ions is preferably translated along the length of the ion guide in an axial potential or axial pseudo-potential well. When a particular axial potential or axial pseudo-potential well reaches the end of the ion guide then the packet of ions is preferably released from the ion guide. The ions are then preferably onwardly transmitted to the Time of Flight mass analyser.

According to an embodiment, second and/or third and/or fourth and/or fifth and/or sixth and/or seventh and/or eighth and/or ninth and/or tenth and/or further pulses or packets of ions are released from the ion guide.

The control device is preferably arranged and adapted to energise the orthogonal acceleration electrode a third time after a third delay time $\Delta t_{1-3}$ from the first release time T1 and/or a fourth time after a fourth delay time $\Delta t_{1-4}$ from the first release time T1 and/or a fifth time after a fifth delay time $\Delta t_{1-5}$ from the first release time T1 and/or a sixth time after a sixth delay time $\Delta t_{1-6}$ from the first release time T1 and/or a seventh time after a seventh delay time $\Delta t_{1-7}$ from the first release time T1 and/or an eighth time after an eighth delay time $\Delta t_{1-8}$ from the first release time T1 and/or a ninth time after a ninth delay time $\Delta t_{1-9}$ from the first release time T1 and/or a tenth time after a tenth delay time $\Delta t_{1-10}$ from the first release time T1 and prior to the release of a second pulse or packet of ions at a second release time T2.

The first delay time $\Delta t_{1-1}$ and/or the second delay time $\Delta t_{1-2}$ and/or the third delay time $\Delta t_{1-3}$ and/or the fourth delay time $\Delta t_{1-4}$ and/or the fifth delay time $\Delta t_{1-5}$ and/or the sixth delay time $\Delta t_{1-6}$ and/or the seventh delay time $\Delta t_{1-7}$ and/or the eighth delay time $\Delta t_{1-8}$ and/or the ninth delay time $\Delta t_{1-9}$ and/or the tenth delay time $\Delta t_{1-10}$ are preferably predetermined delay times subsequent to the first release time T1.

A second pulse or packet of ions is preferably released at a second release time T2. The control device is preferably arranged and adapted to energise the orthogonal acceleration electrode a first time after a first delay time $\Delta t_{2-1}$ from the second release time T2 and at least a second subsequent time after a second delay time $\Delta t_{2-2}$ from the second release time T2 and prior to the release of a third pulse or packet of ions at a third release time T3.

The control device is preferably arranged and adapted to energise the orthogonal acceleration electrode a third time after a third delay time $\Delta t_{2-3}$ from the second release time T2 and/or a fourth time after a fourth delay time $\Delta t_{2-4}$ from the second release time T2 and/or a fifth time after a fifth delay time $\Delta t_{2-5}$ from the second release time T2 and/or a sixth time after a sixth delay time $\Delta t_{2-6}$ from the second release time T2 and/or a seventh time after a seventh delay time $\Delta t_{2-7}$ from the second release time T2 and/or an eighth time after an eighth delay time $\Delta t_{2-8}$ from the second release time T2 and/or a ninth time after a ninth delay time $\Delta t_{2-9}$ from the second release time T2 and/or a tenth time after a tenth delay time $\Delta t_{2-10}$ from the second release time T2 and prior to the release of a third pulse or packet of ions at a third release time T3.

The first delay time $\Delta t_{2-1}$ and/or the second delay time $\Delta t_{2-2}$ and/or the third delay time $\Delta t_{2-3}$ and/or the fourth delay time $\Delta t_{2-4}$ and/or the fifth delay time $\Delta t_{2-5}$ and/or the sixth delay time $\Delta t_{2-6}$ and/or the seventh delay time $\Delta t_{2-7}$ and/or the eighth delay time $\Delta t_{2-8}$ and/or the ninth delay time $\Delta t_{2-9}$ and/or the tenth delay time $\Delta t_{2-10}$ are preferably predetermined delay times subsequent to the second release time T2.

A third pulse or packet of ions is preferably released at a third release time T3. The control device is preferably arranged and adapted to energise the orthogonal acceleration electrode a first time after a first delay time $\Delta t_{3-1}$ from the third release time T3 and at least a second subsequent time after a second delay time $\Delta t_{3-2}$ from the third release time T3 and prior to the release of a fourth pulse or packet of ions at a fourth release time T4.

The control device is preferably arranged and adapted to energise the orthogonal acceleration electrode a third time after a third delay time $\Delta t_{3-3}$ from the third release time T3 and/or a fourth time after a fourth delay time $\Delta t_{3-4}$ from the third release time T3 and/or a fifth time after a fifth delay time $\Delta t_{3-5}$ from the third release time T3 and/or a sixth time after a sixth delay time $\Delta t_{3-6}$ from the third release time T3 and/or a seventh time after a seventh delay time $\Delta t_{3-7}$ from the third release time T3 and/or an eighth time after an eighth delay time $\Delta t_{3-8}$ from the third release time T3 and/or a ninth time after a ninth delay time $\Delta t_{3-9}$ from the third release time T3 and/or a tenth time after a tenth delay time $\Delta t_{3-10}$ from the third release time T3 and prior to the release of a fourth pulse or packet of ions at a fourth release time T4.

The first delay time $\Delta t_{3-1}$ and/or the second delay time $\Delta t_{3-2}$ and/or the third delay time $\Delta t_{3-3}$ and/or the fourth delay time $\Delta t_{3-4}$ and/or the fifth delay time $\Delta t_{3-5}$ and/or the sixth delay time $\Delta t_{3-6}$ and/or the seventh delay time $\Delta t_{3-7}$ and/or the eighth delay time $\Delta t_{3-8}$ and/or the ninth delay time $\Delta t_{3-9}$ and/or the tenth delay time $\Delta t_{3-10}$ are preferably predetermined delay times subsequent to the third release time T3.

A fourth pulse or packet of ions is preferably released at a fourth release time T4. The control device is preferably arranged and adapted to energise the orthogonal acceleration electrode a first time after a first delay time $\Delta t_{4-1}$ from the fourth release time T4 and at least a second subsequent time after a second delay $\Delta t_{4-2}$ from the fourth release time T4 and prior to the release of a fifth pulse or packet of ions at a fifth release time T5.

The control device is preferably arranged and adapted to energise the orthogonal acceleration electrode a third time after a third delay time $\Delta t_{4-3}$ from the fourth release time T4 and/or a fourth time after a fourth delay time $\Delta t_{4-4}$ from the fourth release time T4 and/or a fifth time after a fifth delay time $\Delta t_{4-5}$ from the fourth release time T4 and/or a sixth time after a sixth delay time $\Delta t_{4-6}$ from the fourth release time T4 and/or a seventh time after a seventh delay time $\Delta t_{4-7}$ from the fourth release time T4 and/or an eighth time after an eighth delay time $\Delta t_{4-8}$ from the fourth release time T4 and/or a ninth time after a ninth delay time $\Delta t_{4-9}$ from the fourth release time T4 and/or a tenth time after a tenth delay time $\Delta t_{4-10}$ from the fourth release time T4 and prior to the release of a fifth pulse or packet of ions at a fifth release time T5.

The first delay time $\Delta t_{4-1}$ and/or the second delay time $\Delta t_{4-2}$ and/or the third delay time $\Delta t_{4-3}$ and/or the fourth delay time $\Delta t_{4-4}$ and/or the fifth delay time $\Delta t_{4-5}$ and/or the sixth delay time $\Delta t_{4-6}$ and/or the seventh delay time $\Delta t_{4-7}$ and/or the eighth delay time $\Delta t_{4-8}$ and/or the ninth delay time $\Delta t_{4-9}$ and/or the tenth delay time $\Delta t_{4-10}$ are preferably predetermined delay times subsequent to the fourth release time T4.

A fifth pulse or packet of ions is preferably released at a fifth release time T5. The control device is preferably arranged and adapted to energise the orthogonal acceleration electrode a first time after a first delay time $\Delta t_{5-1}$ from the fifth release time T5 and at least a second subsequent time after a second delay time $\Delta t_{5-2}$ from the fifth release time T5 and prior to the release of a sixth pulse or packet of ions at a sixth release time T6.

The control device is preferably arranged and adapted to energise the orthogonal acceleration electrode a third time after a third delay time $\Delta t_{5-3}$ from the fifth release time T5 and/or a fourth time after a fourth delay time $\Delta t_{5-4}$ from the fifth release time T5 and/or a fifth time after a fifth delay time $\Delta t_{5-5}$ from the fifth release time T5 and/or a sixth time after a sixth delay time $\Delta t_{5-6}$ from the fifth release time T5 and/or a seventh time after a seventh delay time $\Delta t_{5-7}$ from the fifth release time T5 and/or an eighth time after an eighth delay time $\Delta t_{5-8}$ from the fifth release time T5 and/or a ninth time after a ninth delay time $\Delta t_{5-9}$ from the fifth release time T5 and/or a tenth time after a tenth delay time $\Delta t_{5-10}$ from the fifth release time T5 and prior to the release of a sixth pulse or packet of ions at a sixth release time T6.

The first delay time $\Delta t_{5-1}$ and/or the second delay time $\Delta t_{5-2}$ and/or the third delay time $\Delta t_{5-3}$ and/or the fourth delay time $\Delta t_{5-4}$ and/or the fifth delay time $\Delta t_{5-5}$ and/or the sixth delay time $\Delta t_{5-6}$ and/or the seventh delay time $\Delta t_{5-7}$ and/or the eighth delay time $\Delta t_{5-8}$ and/or the ninth delay time $\Delta t_{5-9}$ and/or the tenth delay time $\Delta t_{5-10}$ are preferably predetermined delay times subsequent to the fifth release time T5.

According to an embodiment: (i) the first delay time $\Delta t_{1-1}$ from the first release time T1 and/or the first delay time $\Delta t_{2-1}$ from the second release time T2 and/or the first delay time $\Delta t_{3-1}$ from the third release time T3 and/or the first delay time $\Delta t_{4-1}$ from the fourth release time T4 and/or the first delay time $\Delta t_{5-1}$ from the fifth release time T5 are substantially the same; and/or (ii) the second delay time $\Delta t_{1-2}$ from the first release time T1 and/or the second delay time $\Delta t_{2-2}$ from the second release time T2 and/or the second delay time $\Delta t_{3-2}$ from the third release time T3 and/or the second delay time $\Delta t_{4-2}$ from the fourth release time T4 and/or the second delay time $\Delta t_{5-2}$ from the fifth release time T5 are substantially the same; and/or (iii) the third delay time $\Delta t_{1-3}$ from the first release time T1 and/or the third delay time $\Delta t_{2-3}$ from the second release time T2 and/or the third delay time $\Delta t_{3-3}$ from the third release time T3 and/or the third delay time $\Delta t_{4-3}$ from the fourth release time T4 and/or the third delay time $\Delta t_{5-3}$ from the fifth release time T5 are substantially the same; and/or (iv) the fourth delay time $\Delta t_{1-4}$ from the first release time T1 and/or the fourth delay time $\Delta t_{2-4}$ from the second release time T2 and/or the fourth delay time $\Delta t_{3-4}$ from the third release time T3 and/or the fourth delay time $\Delta t_{4-4}$ from the fourth release time T4 and/or the fourth delay time $\Delta t_{5-4}$ from the fifth release time T5 are substantially the same; and/or (v) the fifth delay time $\Delta t_{1-5}$ from the first release time T1 and/or the fifth delay time $\Delta t_{2-5}$ from the second release time T2 and/or the fifth delay time $\Delta t_{3-5}$ from the third release time T3 and/or the fifth delay time $\Delta t_{4-5}$ from the fourth release time T4 and/or the fifth delay time $\Delta t_{5-5}$ from the fifth release time T5 are substantially the same.

According to another embodiment: (i) the first delay time $\Delta t_{1-1}$ from the first release time T1 and/or the first delay time $\Delta t_{2-1}$ from the second release time T2 and/or the first delay time $\Delta t_{3-1}$ from the third release time T3 and/or the first delay time $\Delta t_{4-1}$ from the fourth release time T4 and/or the first delay time $\Delta t_{5-1}$ from the fifth release time T5 are substantially different; and/or (ii) the second delay time $\Delta t_{1-2}$ from the first release time T1 and/or the second delay time $\Delta t_{2-2}$ from the second release time T2 and/or the second delay time $\Delta t_{3-2}$ from the third release time T3 and/or the second delay time $\Delta t_{4-2}$ from the fourth release time T4 and/or the second delay time $\Delta t_{5-2}$ from the fifth release time T5 are substantially different; and/or (iii) the third delay time $\Delta t_{1-3}$ from the first release time T1 and/or the third delay time $\Delta t_{2-3}$ from the second release time T2 and/or the third delay time $\Delta t_{3-3}$ from the third release time T3 and/or the third delay time $\Delta t_{4-3}$ from the fourth release time T4 and/or the third delay time $\Delta t_{5-3}$ from the fifth release time T5 are substantially different; and/or (iv) the fourth delay time $\Delta t_{1-4}$ from the first release time T1 and/or the fourth delay time $\Delta t_{2-4}$ from the second release time T2 and/or the fourth delay time $\Delta t_{3-4}$ from the third release time T3 and/or the fourth delay time $\Delta t_{4-4}$ from the fourth release time T4 and/or the fourth delay time $\Delta t_{5-4}$ from the fifth release time T5 are substantially different; and/or (v) the fifth delay time $\Delta t_{1-5}$ from the first release time T1 and/or the fifth delay time $\Delta t_{2-5}$ from the second release time T2 and/or the fifth delay time $\Delta t_{3-5}$ from the third release time T3 and/or the fifth delay time $\Delta t_{4-5}$ from the fourth release time T4 and/or the fifth delay time $\Delta t_{5-5}$ from the fifth release time T5 are substantially different.

According to an embodiment the first delay time $\Delta t_{1-1}$ from the first release time T1 and/or the first delay time $\Delta t_{2-1}$ from the second release time T2 and/or the first delay time $\Delta t_{3-1}$ from the third release time T3 and/or the first delay time $\Delta t_{4-1}$ from the fourth release time T4 and/or the first delay time $\Delta t_{5-1}$ from the fifth release time T5 are preferably selected from the group consisting of: (i) <1 μs; (ii) 1-2 μs; (iii) 2-3 μs; (iv) 3-4 μs; (v) 4-5 μs; (vi) 5-6 μs; (vii) 6-7 μs; (viii) 7-8 μs; (ix) 8-9 μs; (x) 9-10 μs; (xi) 10-11 μs; (xii) 11-12 μs; (xiii) 12-13 μs; (xiv) 13-14 μs; (xv) 14-15 μs; (xvi) 15-16 μs; (xvii) 16-17 μs; (xxiii) 17-18 μs; (xix) 18-19 μs; (xx) 19-20 μs; (xxi) 20-25 μs; (xxii) 25-30 μs; (xxiii) 30-35 μs; (xxiv) 35-40 μs; (xxv) 40-45 μs; (xxvi) 45-50 μs; (xxvii) 50-55 μs; (xxviii) 55-60 μs; (xxix) 60-65 μs; (xxx) 65-70 μs; (xxxi) 70-75 μs; (xxiii) 75-80 μs; (xxxiii) 80-85 μs; (xxxiv) 85-90 μs; (xxxv) 90-95 μs; (xxxvi) 95-100 μs; (xxxvii) 100-120 μs; (xxxviii) 120-140 μs; (xxxix) 140-160 μs; (xl) 160-180 μs; (xli) 180-200 μs; and (xlii) >200 μs.

According to an embodiment the second delay time $\Delta t_{1-2}$ from the first release time T1 and/or the second delay time $\Delta t_{2-2}$ from the second release time T2 and/or the second delay time $\Delta t_{3-2}$ from the third release time T3 and/or the second delay time $\Delta t_{4-2}$ from the fourth release time T4 and/or the second delay time $\Delta t_{5-2}$ from the fifth release time T5 are preferably selected from the group consisting of: (i) <1 μs; (ii) 1-2 μs; (iii) 2-3 μs; (iv) 3-4 μs; (v) 4-5 μs; (vi) 5-6 μs; (vii) 6-7 μs; (viii) 7-8 μs; (ix) 8-9 μs; (x) 9-10 μs; (xi) 10-11 μs; (xii) 11-12 μs; (xiii) 12-13 μs; (xiv) 13-14 μs; (xv) 14-15 μs; (xvi) 15-16 μs; (xvii) 16-17 μs; (xviii) 17-18 μs; (xix) 18-19 μs; (xx) 19-20 μs; (xxi) 20-25 μs; (xxii) 25-30 μs; (xxiii) 30-35 μs; (xxiv) 35-40 μs; (xxv) 40-45 μs; (xxvi) 45-50 μs; (xxvii) 50-55 μs; (xxviii) 55-60 μs; (xxix) 60-65 μs; (xxx) 65-70 μs; (xxxi) 70-75 μs; (xxxii) 75-80 μs; (xxxiii) 80-85 μs; (xxxiv) 85-90 μs; (xxxv) 90-95 μs; (xxxvi) 95-100 μs; (xxxvii) 100-120 μs; (xxxviii) 120-140 μs; (xxxix) 140-160 μs; (xl) 160-180 μs; (xli) 180-200 μs; and (xlii) >200 μs.

According to an embodiment the third delay time $\Delta t_{1-3}$ from the first release time T1 and/or the third delay time $\Delta t_{2-3}$ from the second release time T2 and/or the third delay time $\Delta t_{3-3}$ from the third release time T3 and/or the third delay time $\Delta t_{4-3}$ from the fourth release time T4 and/or the third delay time $\Delta t_{5-3}$ from the fifth release time T5 are substantially different are preferably selected from the group consisting of: (i) <1 μs; (ii) 1-2 μs; (iii) 2-3 μs; (iv) 3-4 μs; (v) 4-5 μs; (vi) 5-6 μs; (vii) 6-7 μs; (viii) 7-8 μs; (ix) 8-9 μs; (x) 9-10 μs; (xi) 10-11 μs; (xii) 11-12 μs; (xiii) 12-13 μs; (xiv) 13-14 μs; (xv) 14-15 μs; (xvi) 15-16 μs; (xvii) 16-17 μs; (xviii) 17-18 μs; (xix) 18-19 μs; (xx) 19-20 μs; (xxi) 20-25 μs; (xxii) 25-30 μs; (xxiii) 30-35 μs; (xxiv) 35-40 μs; (xxv) 40-45 μs; (xxvi) 45-50 μs; (xxvii) 50-55 μs; (xxviii) 55-60 μs; (xxix) 60-65 μs; (xxx)

65-70 μs; (xxxi) 70-75 μs; (xxxii) 75-80 μs; (xxxiii) 80-85 μs; (xxxiv) 85-90 μs; (xxxv) 90-95 μs; (xxxvi) 95-100 μs; (xxxvii) 100-120 μs; (xxxviii) 120-140 μs; (xxxix) 140-160 μs; (xl) 160-180 μs; (xli) 180-200 μs; and (xlii) >200 μs.

According to an embodiment the fourth delay time $\Delta t_{1-4}$ from the first release time T1 and/or the fourth delay time $\Delta t_{2-4}$ from the second release time T2 and/or the fourth delay time $\Delta t_{3-4}$ from the third release time T3 and/or the fourth delay time $\Delta t_{4-4}$ from the fourth release time T4 and/or the fourth delay time $\Delta t_{5-4}$ from the fifth release time T5 are substantially different are preferably selected from the group consisting of: (i) <1 μs; (ii) 1-2 μs; (iii) 2-3 μs; (iv) 3-4 μs; (v) 4-5 μs; (vi) 5-6 μs; (vii) 6-7 μs; (viii) 7-8 μs; (ix) 8-9 μs; (x) 9-10 μs; (xi) 10-11 μs; (xii) 11-12 μs; (xiii) 12-13 μs; (xiv) 13-14 μs; (xv) 14-15 μs; (xvi) 15-16 μs; (xvii) 16-17 μs; (xviii) 17-18 μs; (xix) 18-19 μs; (xx) 19-20 μs; (xxi) 20-25 μs; (xxii) 25-30 μs; (xxiii) 30-35 μs; (xxiv) 35-40 μs; (xxv) 40-45 μs; (xxvi) 45-50 μs; (xxvii) 50-55 μs; (xxviii) 55-60 μs; (xxix) 60-65 μs; (xxx) 65-70 μs; (xxxi) 70-75 μs; (xxxii) 75-80 μs; (xxxiii) 80-85 μs; (xxxiv) 85-90 μs; (xxxv) 90-95 μs; (xxxvi) 95-100 μs; (xxxvii) 100-120 μs; (xxxviii) 120-140 μs; (xxxix) 140-160 μs; (xl) 160-180 μs; (xli) 180-200 μs; and (xlii) >200 μs.

According to an embodiment the fifth delay time $\Delta t_{1-5}$ from the first release time T1 and/or the fifth delay time $\Delta t_{2-5}$ from the second release time T2 and/or the fifth delay time $\Delta t_{3-5}$ from the third release time T3 and/or the fifth delay time $\Delta t_{4-5}$ from the fourth release time T4 and/or the fifth delay time $\Delta t_{5-5}$ from the fifth release time T5 are preferably selected from the group consisting of: (i) <1 μs; (ii) 1-2 μs; (iii) 2-3 μs; (iv) 3-4 μs; (v) 4-5 μs; (vi) 5-6 μs; (vii) 6-7 μs; (viii) 7-8 μs; (ix) 8-9 μs; (x) 9-10 μs; (xi) 10-11 μs; (xii) 11-12 μs; (xiii) 12-13 μs; (xiv) 13-14 μs; (xv) 14-15 μs; (xvi) 15-16 μs; (xvii) 16-17 μs; (xviii) 17-18 μs; (xix) 18-19 μs; (xx) 19-20 μs; (xxi) 20-25 μs; (xxii) 25-30 μs; (xxviii) 30-35 μs; (xxiv) 35-40 μs; (xxv) 40-45 μs; (xxvi) 45-50 μs; (xxvii) 50-55 μs; (xxviii) 55-60 μs; (xxix) 60-65 μs; (xxx) 65-70 μs; (xxxi) 70-75 μs; (xxxii) 75-80 μs; (xxxiii) 80-85 μs; (xxxiv) 85-90 μs; (xxxv) 90-95 μs; (xxxvi) 95-100 μs; (xxxvii) 100-120 μs; (xxxviii) 120-140 μs; (xxxix) 140-160 μs; (xl) 160-180 μs; (xli) 180-200 μs; and (xlii) >200 μs.

The control device is preferably arranged and adapted to energise the orthogonal acceleration electrode x times prior to the release of a subsequent pulse or packet of ions, wherein x is selected from the group consisting of: (i) 2; (ii) 3; (iii) 4; (iv) 5; (v) 6; (vi) 7; (vii) 8; (viii) 9; (ix) 10; (x) 11; (xi) 12; (xii) 13; (xiii) 14; (xiv) 15; (xv) 16; (xvi) 17; (xvii) 18; (xviii) 19; (xix) 20; and (xx) >20.

The first delay time is preferably varied, increased, decreased or progressively changed after each release of a pulse or packet of ions.

The second delay time is preferably varied, increased, decreased or progressively changed after each release of a pulse or packet of ions.

The third delay time is preferably varied, increased, decreased or progressively changed after each release of a pulse or packet of ions.

The fourth delay time is preferably varied, increased, decreased or progressively changed after each release of a pulse or packet of ions.

The fifth delay time is preferably varied, increased, decreased or progressively changed after each release of a pulse or packet of ions.

According to an embodiment after the release of a pulse or packet of ions at a n-th release time Tn there is a constant, increasing, decreasing, linear, non-linear, quadratic, exponential, polynomial or other predetermined relationship between the first delay time $\Delta t_{n-1}$ and/or the second delay time $\Delta t_{n-2}$ and/or the third delay time $\Delta t_{n-3}$ and/or the fourth delay time $\Delta t_{n-4}$ and/or the fifth delay time $\Delta t_{n-5}$ and/or the sixth delay time $\Delta t_{n-6}$ and/or the seventh delay time $\Delta t_{n-7}$ and/or the eighth delay time $\Delta t_{n-8}$ and/or the ninth delay time $\Delta t_{n-9}$ and/or the tenth delay time $\Delta t_{n-10}$ from the n-th release time Tn and prior to the release of a subsequent pulse of ions at a later release time Tn+1, wherein n is selected from one or more of the following: (i) 1; (ii) 2; (iii) 3; (iv) 4; (v) 5; (vi) 6; (vii) 7; (viii) 8; (ix) 9; and (x) 10. According to an embodiment, n may be in the range 10-20, 20-30, 30-40, 40-50, 50-60, 60-70, 70-80, 80-90, 90-100, 100-110, 110-120, 120-130, 130-140, 140-150, 150-160, 160-170, 170-180, 180-190, 190-200, 200-250, 250-300, 300-350, 350-400, 400-450, 450-500 and >500.

According to an embodiment there may be a constant, increasing, decreasing, linear, non-linear, quadratic, exponential, polynomial or other predetermined relationship between the release times Tn at which a pulse or packet of ions is released. An exponential relationship is particularly preferred. Also, cycles of operation may be performed in various different orders and the mass spectral data may then be interleaved or assembled into a composite set of mass spectral data.

The Time of Flight mass analyser preferably comprises an orthogonal acceleration Time of Flight mass analyser.

The Time of Flight mass analyser preferably further comprises a reflectron and an ion detector, wherein in use at least some ions are orthogonally accelerated by energisation of the orthogonal acceleration electrode into the drift region and wherein the ions which are orthogonally accelerated are then reflected by the reflectron and are directed so as to impinge upon the ion detector.

According to another aspect of the present invention there is provided a mass spectrometer comprising a Time of Flight mass analyser as disclosed above.

According to an embodiment the mass spectrometer may comprise an ion trap, ion trapping region or ion gate arranged preferably upstream of the Time of Flight mass analyser. The ion trap, ion trapping region or ion gate is preferably arranged and adapted to periodically release or transmit a pulse or packet of ions. In a cycle of operation the ion trap, ion trapping region or ion gate is preferably arranged to onwardly transmit or pass ions from the ion trap, ion trapping region or ion gate towards an orthogonal acceleration region arranged adjacent the orthogonal acceleration electrode during a time period xl and substantially to prevent the onward transmission or passing of ions from the ion trap, ion trapping region or ion gate towards the orthogonal acceleration region arranged adjacent the orthogonal acceleration electrode during a time period x2. Preferably, x2>x1.

Preferably, x1 and/or x2 are selected from the group consisting of: (i) <1 μs; (ii) 1-2 μs; (iii) 2-3 μs; (iv) 3-4 μs; (v) 4-5 μs; (vi) 5-6 μs; (vii) 6-7 μs; (viii) 7-8 μs; (ix) 8-9 μs; (x) 9-10 μs; (xi) 10-11 μs; (xii) 11-12 μs; (xiii) 12-13 μs; (xiv) 13-14 μs; (xv) 14-15 μs; (xvi) 15-16 μs; (xvii) 16-17 μs; (xviii) 17-18 μs; (xix) 18-19 μs; (xx) 19-20 μs; (xxi) 20-25 μs; (xxii) 25-30 μs; (xxiii) 30-35 μs; (xxiv) 35-40 μs; (xxv) 40-45 μs; (xxvi) 45-50 μs; (xxvii) 50-55 μs; (xxviii) 55-60 μs; (xxix) 60-65 μs; (xxx) 65-70 μs; (xxxi) 70-75 μs; (xxxii) 75-80 μs; (xxxiii) 80-85 μs; (xxxiv) 85-90 μs; (xxxv) 90-95 μs; (xxxvi) 95-100 μs; (xxxvii) 100-120 μs; (xxxviii) 120-140 μs; (xxxix) 140-160 μs; (xl) 160-180 μs; (xli) 180-200 μs; and (xlii) >200 μs.

The ratio x2/x1 is preferably selected from the group consisting of: (i) 1-5; (ii) 5-10; (iii) 10-15; (iv) 15-20; (v) 20-25; (vi) 25-30; (vii) 30-35; (viii) 35-40; (ix) 40-45; (x) 45-50; (xi) 50-55; (xii) 55-60; (xiii) 60-65; (xiv) 65-70; (xv) 70-75; (xvi)

75-80; (xvii) 80-85; (xviii) 85-90; (xix) 90-95; (xx) 95-100; (xxi) 100-120; (xxii) 120-140; (xxiii) 140-160; (xxiv) 160-180; (xxv) 180-200; and (xxvi) >200.

The first pulse or packet of ions is preferably released or onwardly transmitted from the ion trap, ion trapping region or ion gate at the first release time T1 and/or wherein the second pulse or packet of ions is preferably released or onwardly transmitted from the ion trap, ion trapping region or ion gate at the second release time T2 and/or wherein the third pulse or packet of ions is preferably released or onwardly transmitted from the ion trap, ion trapping region or ion gate at the third release time T3 and/or wherein the fourth pulse or packet of ions is preferably released or onwardly transmitted from the ion trap, ion trapping region or ion gate at the fourth release time T4 and/or wherein the fifth pulse or packet of ions is preferably released or onwardly transmitted from the ion trap, ion trapping region or ion gate at the fifth release time T5.

The ion trap, ion trapping region or ion gate preferably comprises a plurality of electrodes arranged upstream of the Time of Flight mass analyser. The ion trap, ion trapping region or ion gate preferably comprises: (i) a multipole rod set or a segmented multipole rod set; (ii) an ion tunnel or ion funnel; or (iii) a stack or array of planar, plate or mesh electrodes.

According to another embodiment the mass spectrometer comprises an ion guide arranged preferably upstream of the mass analyser. According to the preferred embodiment one or more axial potential wells or one or more axial pseudo-potential wells are preferably translated along the length of the ion guide and wherein when an axial potential well or an axial pseudo-potential well reaches the end or exit region of the ion guide ions contained within the axial potential well or the axial pseudo-potential well are preferably caused to be released. The ions are preferably onwardly transmitted as a pulse or packet of ions.

The first pulse or packet of ions is preferably released or onwardly transmitted from the ion guide at the first release time T1 and/or wherein the second pulse or packet of ions is preferably released or onwardly transmitted from the ion guide at the second release time T2 and/or wherein the third pulse or packet of ions is preferably released or onwardly transmitted from the ion guide at the third release time T3 and/or wherein the fourth pulse or packet of ions is preferably released or onwardly transmitted from the ion guide at the fourth release time T4 and/or wherein the fifth pulse or packet of ions is preferably released or onwardly transmitted from the ion guide at the fifth release time T5.

Various embodiments have been described above in detail wherein up to five pulses or packets of ions are released either from an ion trap, ion trapping region or ion gate or alternatively from an ion guide (preferably a travelling wave ion guide). However, further embodiments are contemplated wherein at least 5-10, 10-20, 20-30, 30-40, 40-50, 50-60, 60-70, 70-80, 80-90, 90-100, 100-110, 110-120, 120-130, 130-140, 140-150, 150-160, 160-170, 170-180, 180-190, 190-200, 200-250, 250-300, 300-350, 350-400, 400-450, 450-500 or >500 pulses or packets of ions are released in an experimental run.

The ion guide preferably comprises a plurality of electrodes arranged upstream of the Time of Flight mass analyser. The ion guide preferably comprises: (i) a multipole rod set or a segmented multipole rod set; (ii) an ion tunnel or ion funnel; or (iii) a stack or array of planar, plate or mesh electrodes.

The multipole rod set preferably comprises a quadrupole rod set, a hexapole rod set, an octapole rod set or a rod set comprising more than eight rods.

The ion tunnel or ion funnel preferably comprises a plurality of electrodes or at least 2, 5, 10, 20, 30, 40, 50, 60, 70, 80, 90 or 100 electrodes having apertures through which ions are transmitted in use, wherein at least 5%, 10%, 15%, 20%, 25%, 30%, 35%, 40%, 45%, 50%, 55%, 60%, 65%, 70%, 75%, 80%, 85%, 90%, 95% or 100% of the electrodes have apertures which are of substantially the same size or area or which have apertures which become progressively larger and/or smaller in size or in area. At least 5%, 10%, 15%, 20%, 25%, 30%, 35%, 40%, 45%, 50%, 55%, 60%, 65%, 70%, 75%, 80%, 85%, 90%, 95% or 100% of the electrodes preferably have internal diameters or dimensions selected from the group consisting of: (i) ≦1.0 mm; (ii) ≦2.0 mm; (iii) ≦3.0 mm; (iv) ≦4.0 mm; (v) ≦5.0 mm; (vi) ≦6.0 mm; (vii) ≦7.0 mm; (viii) ≦8.0 mm; (ix) ≦9.0 mm; (x) ≦10.0 mm; and (xi) >10.0 mm.

The stack or array of planar, plate or mesh electrodes preferably comprises a plurality or at least 2, 3, 4, 5, 6, 7, 8, 9, 10, 11, 12, 13, 14, 15, 16, 17, 18, 19 or 20 planar, plate or mesh electrodes wherein at least 5%, 10%, 15%, 20%, 25%, 30%, 35%, 40%, 45%, 50%, 55%, 60%, 65%, 70%, 75%, 80%, 85%, 90%, 95% or 100% of the planar, plate or mesh electrodes are arranged generally in the plane in which ions travel in use. At least some or at least 5%, 10%, 15%, 20%, 25%, 30%, 35%, 40%, 45%, 50%, 55%, 60%, 65%, 70%, 75%, 80%, 85%, 90%, 95% or 100% of the planar, plate or mesh electrodes are preferably supplied with an AC or RF voltage and wherein adjacent planar, plate or mesh electrodes are supplied with opposite phases of the AC or RF voltage.

The ion guide preferably comprises a plurality of axial segments or at least 5, 10, 15, 20, 25, 30, 35, 40, 45, 50, 55, 60, 65, 70, 75, 80, 85, 90, 95 or 100 axial segments.

The ion guide preferably has an axial length selected from the group consisting of: (i) <20 mm; (ii) 20-40 mm; (iii) 40-60 mm; (iv) 60-80 mm; (v) 80-100 mm; (vi) 100-120 mm; (vii) 120-140 mm; (viii) 140-160 mm; (ix) 160-180 mm; (x) 180-200 mm; (xi) 200-220 mm; (xii) 220-240 mm; (xiii) 240-260 mm; (xiv) 260-280 mm; (xv) 280-300 mm; and (xvi) >300 mm.

The mass spectrometer preferably further comprises DC voltage means for maintaining a substantially constant DC voltage gradient along at least a portion or at least 5%, 10%, 15%, 20%, 25%, 30%, 35%, 40%, 45%, 50%, 55%, 60%, 65%, 70%, 75%, 80%, 85%, 90%, 95% or 100% of the axial length of the ion guide in order to urge at least some ions along at least a portion or at least 5%, 10%, 15%, 20%, 25%, 30%, 35%, 40%, 45%, 50%, 55%, 60%, 65%, 70%, 75%, 80%, 85%, 90%, 95% or 100% of the axial length of the ion guide.

The mass spectrometer preferably further comprises transient DC voltage means arranged and adapted to apply one or more transient DC voltages or potentials or one or more transient DC voltage or potential waveforms to at least some of the electrodes forming the ion guide in order to urge at least some ions along at least 5%, 10%, 15%, 20%, 25%, 30%, 35%, 40%, 45%, 50%, 55%, 60%, 65%, 70%, 75%, 80%, 85%, 90%, 95% or 100% of the axial length of the ion guide. The ion guide is preferably arranged and adapted to receive a continuous or pseudo-continuous beam of ions. The application of one or more transient DC voltages or potentials or one or more transient DC voltage or potential waveforms to at least some of the electrodes forming the ion guide preferably converts or partitions the beam of ions such that at least 1, 2, 3, 4, 5, 6, 7, 8, 9, 10, 11, 12, 13, 14, 15, 16, 17, 18, 19 or 20 separate groups or packets of ions are confined and/or isolated in the ion guide at any particular time. Each group or packet of ions is preferably separately confined and/or isolated in a separate axial potential well formed in the ion guide.

The one or more transient DC voltages or potentials or one or more transient DC voltage or potential waveforms are preferably translated along the length of the ion guide so that at least 1, 2, 3, 4, 5, 6, 7, 8, 9, 10, 11, 12, 13, 14, 15, 16, 17, 18, 19 or 20 separate groups or packets of ions are confined and/or isolated in the ion guide at any particular time and are preferably axially translated along the length of the ion guide.

The mass spectrometer preferably further comprises AC or RF voltage means arranged and adapted to apply two or more phase-shifted AC or RF voltages to electrodes forming the ion guide in order to urge at least some ions along at least 5%, 10%, 15%, 20%, 25%, 30%, 35%, 40%, 45%, 50%, 55%, 60%, 65%, 70%, 75%, 80%, 85%, 90%, 95% or 100% of the axial length of the ion guide.

The mass spectrometer preferably further comprises means for applying a single phase AC or RF voltage across at least a portion of the length of the ion guide in order to generate an axial pseudo-potential. The axial pseudo-potential is preferably arranged to urge at least some ions along at least 5%, 10%, 15%, 20%, 25%, 30%, 35%, 40%, 45%, 50%, 55%, 60%, 65%, 70%, 75%, 80%, 85%, 90%, 95% or 100% of the axial length of the ion guide.

The mass spectrometer preferably further comprises a further mass filter or mass analyser which is preferably arranged upstream of the Time of Flight mass analyser. The further mass filter or mass analyser is preferably selected from the group consisting of: (i) a quadrupole rod set mass filter; (ii) a Time of Flight mass filter or mass analyser; (iii) a Wein filter; and (iv) a magnetic sector mass filter or mass analyser.

The mass spectrometer preferably further comprises a collision, fragmentation or reaction device. The collision, fragmentation or reaction device is preferably arranged and adapted to fragment ions by Collision Induced Dissociation ("CID"). Alternatively, the collision, fragmentation or reaction device may be selected from the group consisting of: (i) a Surface Induced Dissociation ("SID") fragmentation device; (ii) an Electron Transfer Dissociation fragmentation device; (iii) an Electron Capture Dissociation fragmentation device; (iv) an Electron Collision or Impact Dissociation fragmentation device; (v) a Photo Induced Dissociation ("PID") fragmentation device; (vi) a Laser Induced Dissociation fragmentation device; (vii) an infrared radiation induced dissociation device; (viii) an ultraviolet radiation induced dissociation device; (ix) a nozzle-skimmer interface fragmentation device; (x) an in-source fragmentation device; (xi) an ion-source Collision Induced Dissociation fragmentation device; (xii) a thermal or temperature source fragmentation device; (xiii) an electric field induced fragmentation device; (xiv) a magnetic field induced fragmentation device; (xv) an enzyme digestion or enzyme degradation fragmentation device; (xvi) an ion-ion reaction fragmentation device; (xvii) an ion-molecule reaction fragmentation device; (xviii) an ion-atom reaction fragmentation device; (xix) an ion-metastable ion reaction fragmentation device; (xx) an ion-metastable molecule reaction fragmentation device; (xxi) an ion-metastable atom reaction fragmentation device; (xxii) an ion-ion reaction device for reacting ions to foils adduct or product ions; (xxiii) an ion-molecule reaction device for reacting ions to form adduct or product ions; (xxiv) an ion-atom reaction device for reacting ions to form adduct or product ions; (xxv) an ion-metastable ion reaction device for reacting ions to form adduct or product ions; (xxvi) an ion-metastable molecule reaction device for reacting ions to form adduct or product ions; and (xxvii) an ion-metastable atom reaction device for reacting ions to form adduct or product ions.

According to an embodiment the mass spectrometer may further comprise acceleration means arranged and adapted to accelerate ions into the collision, fragmentation or reaction device wherein in a mode of operation at least 5%, 10%, 15%, 20%, 25%, 30%, 35%, 40%, 45%, 50%, 55%, 60%, 65%, 70%, 75%, 80%, 85%, 90%, 95% or 100% of the ions are caused to fragment or react upon entering the collision, fragmentation or reaction device.

The mass spectrometer preferably further comprises a control system arranged and adapted to switch or repeatedly switch the potential difference through which ions pass prior to entering the collision, fragmentation or reaction device between a relatively high fragmentation or reaction mode of operation wherein ions are substantially fragmented or reacted upon entering the collision, fragmentation or reaction device and a relatively low fragmentation or reaction mode of operation wherein substantially fewer ions are fragmented or reacted or wherein substantially no ions are fragmented or reacted upon entering the collision, fragmentation or reaction device. In the relatively high fragmentation or reaction mode of operation ions entering the collision, fragmentation or reaction device are preferably accelerated through a potential difference selected from the group consisting of: (i) ≧10 V; (ii) ≧20 V; (iii) ≧30 V; (iv) ≧40 V; (v) ≧50 V; (vi) ≧60 V; (vii) ≧70 V; (viii) ≧80 V; (ix) ≧90 V; (x) ≧100 V; (xi) ≧110 V; (xii) ≧120 V; (xiii) ≧130 V; (xiv) ≧140 V; (xv) ≧150 V; (xvi) ≧160 V; (xvii) ≧170 V; (xviii) ≧180 V; (xix) ≧190 V; and (xx) ≧200 V. In the relatively low fragmentation or reaction mode of operation ions entering the collision, fragmentation or reaction device are preferably accelerated through a potential difference selected from the group consisting of: (i) ≦20 V; (ii) ≦15 V; (iii) ≦10 V; (iv) ≦5V; and (v) ≦1V.

The control system is preferably arranged and adapted to switch the collision, fragmentation or reaction device between the relatively high fragmentation or reaction mode of operation and the relatively low fragmentation or reaction mode of operation at least once every 1 ms, 5 ms, 10 ms, 15 ms, 20 ms, 25 ms, 30 ms, 35 ms, 40 ms, 45 ms, 50 ms, 55 ms, 60 ms, 65 ms, 70 ms, 75 ms, 80 ms, 85 ms, 90 ms, 95 ms, 100 ms, 200 ms, 300 ms, 400 ms, 500 ms, 600 ms, 700 ms, 800 ms, 900 ms, 1 s, 2 s, 3 s, 4 s, 5 s, 6 s, 7 s, 8 s, 9 s or 10 s.

The collision, fragmentation or reaction device is preferably arranged and adapted to receive a beam of ions and to convert or partition the beam of ions such that at least 1, 2, 3, 4, 5, 6, 7, 8, 9, 10, 11, 12, 13, 14, 15, 16, 17, 18, 19 or 20 separate groups or packets of ions are confined and/or isolated in the collision, fragmentation or reaction device at any particular time, and wherein each group or packet of ions is separately confined and/or isolated in a separate axial potential well formed in the collision, fragmentation or reaction device.

The mass spectrometer preferably further comprises an ion source. The ion source is preferably selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) a Thermospray ion source;

(xviii) a Particle Beam ("PB") ion source; and (xix) a Flow Fast Atom Bombardment ("Flow FAB") ion source.

The mass spectrometer preferably further comprises a continuous or pulsed ion source.

According to another aspect of the present invention there is provided a method of mass analysing ions according to their Time of Flight, comprising:

providing an orthogonal acceleration electrode and a drift region;

releasing a first pulse or packet of ions at a first release time T1;

energising the orthogonal acceleration electrode a first time after a first delay time $\Delta t_{1-4}$ from the first release time T1 and prior to the release of a second pulse or packet of ions at a second release time T2; and energising the orthogonal acceleration electrode at least a second subsequent time after a second delay time $\Delta t_{1-2}$ from the first release time T1 and prior to the release of a second pulse or packet of ions at a second release time T2.

According to another aspect of the present invention there is provided a Time of Flight mass analyser comprising:

a control device which is arranged and adapted to release a first pulse or packet of ions at a first release time T1 and to energise an orthogonal acceleration electrode at multiple predetermined times after the first release time T1 and prior to the release a second pulse or packet of ions at a second release time T2.

The control device is preferably arranged to energise the orthogonal acceleration electrode at a first predetermined delay time $\Delta t_{1-1}$ and at a second different predetermined delay time $\Delta t_{1-2}$ after the first release time T1 and prior to the release of a second pulse or packet of ions at a second release time T2.

The control device is preferably arranged to energise the orthogonal acceleration electrode at a first predetermined delay time $\Delta t_{2-1}$ and at a second different predetermined delay time $\Delta t_{2-2}$ after the second release time T2 and prior to the release of a third pulse or packet of ions at a third release time T3. Preferably, $\Delta t_{1-1} \neq \Delta t_{2-1}$ and/or $\Delta t_{1-2} \neq \Delta t_{2-2}$.

According to another aspect of the present invention there is provided a method of mass analysing ions according to their time of flight comprising:

releasing a first pulse or packet of ions at a first release time T1; and energising an orthogonal acceleration electrode at multiple predetermined times after the first release time T1 and prior to the release a second pulse or packet of ions at a second release time T2.

The method preferably further comprises energising the orthogonal acceleration electrode at a first predetermined delay time $\Delta t_{1-1}$ and at a second different predetermined delay time $\Delta t_{1-2}$ after the first release time T1 and prior to the release of a second pulse or packet of ions at a second release time T2.

The method preferably further comprises energising the orthogonal acceleration electrode at a first predetermined delay time $\Delta t_{2-1}$ and at a second different predetermined delay time $\Delta t_{2-2}$ after the second release time T2 and prior to the release of a third pulse or packet of ions at a third release time T3.

Preferably, $\Delta t_{1-1} \neq \Delta t_{2-1}$ and/or $\Delta t_{1-2} \neq \Delta t_{2-2}$.

According to an embodiment one or more packets of ions are preferably released from an ion trap or other device which is preferably arranged upstream of an orthogonal acceleration Time of Flight mass analyser. The ions in each packet preferably have a variety or range of different mass to charge ratios.

The Time of Flight mass analyser preferably comprises an orthogonal acceleration electrode or a pusher and/or puller electrode. An orthogonal acceleration voltage is preferably applied to the orthogonal acceleration electrode or pusher and/or puller electrode at two or more separate or different delay times after the release of a packet of ions from the ion trap or other device and prior to a release of a subsequent packet of ions from the ion trap or other device.

The orthogonal acceleration voltage is preferably applied to the orthogonal acceleration in synchronism with the release of each packet of ions. According to the preferred embodiment an orthogonal acceleration voltage is preferably applied at two or more pre-determined delay times after the release of each packet of ions and prior to the release of a following or subsequent packet of ions.

According to an embodiment the orthogonal acceleration voltage is applied in synchronism with the release of each packet of ions and is applied at two or more pre-determined delay times after the release of a first packet of ions and is then applied again at two or more different pre-determined delay times after the release of a second subsequent packet of ions.

The preferred embodiment advantageously enables the duty cycle of an orthogonal acceleration Time of Flight mass analyser to be increased or enhanced across a wide mass to charge ratio range compared to the known method of enhancing the duty cycle which is only effective across a narrow mass to charge ratio range.

Another advantage of the preferred embodiment is that the increase or enhancement in duty cycle is also preferably substantially constant across a wide mass to charge ratio range.

A further advantage of the preferred embodiment is that the duty cycle of a limited number of ions of interest may be increased to substantially 100% giving a significant overall duty cycle improvement over arrangements which utilise one orthogonal acceleration pulse per packet of ions released.

The mass spectrometer preferably comprises an ion source. The ion source may comprise a pulsed ion source such as a Laser Desorption Ionisation ("LDI") ion source, a Matrix Assisted Laser Desorption Ionisation ("MALDI") ion source or a Desorption Ionisation on Silicon ("DIOS") ion source.

Alternatively, and more preferably, the mass spectrometer may comprise a continuous ion source. A means for converting a continuous ion beam into a discontinuous ion beam may be provided. For example, an RF ion trap may be provided which may be arranged to store ions and/or periodically release ions.

According to an embodiment a travelling wave RF ion guide may be provided. The RF ion guide preferably comprises a plurality of electrodes. According to this embodiment a continuous ion beam is preferably partitioned or fractionated into a series of packets of ions. Each packet of ions is preferably contained or confined within a separate axial potential well which is preferably translated along the length of the ion guide. One or more transient DC voltages or potentials or one or more transient DC voltage or potential waveforms are preferably applied to the electrodes. One or more axial potential wells are preferably created or generated which are then preferably translated along the length of the ion guide.

According to an embodiment a continuous ion source may be provided. The ion source may, for example, comprise an Electrospray Ionisation ("ESI") ion source, an Atmospheric Pressure Chemical Ionisation ("APCI") ion source, an Electron Impact ("EI") ion source, an Atmospheric Pressure Photon Ionisation ("APPI") ion source, a Chemical Ionisation ("CI") ion source, a Fast Atom Bombardment ("FAB") ion source, a Liquid Secondary Ion Mass Spectrometry ("LSIMS") ion source, a Field Ionisation ("FI") ion source or a Field Desorption ("FD") ion source. Other continuous or pseudo-continuous ion sources may also be used.

The mass spectrometer may comprise a mass filter which may be arranged downstream of the ion source. The mass filter is preferably arranged upstream of the orthogonal acceleration Time of Flight mass analyser. The mass filter may also be arranged upstream of any means for converting a continuous ion beam into a discontinuous ion beam.

According to an embodiment the mass filter may be operated in a mass filtering mode of operation wherein the mass filter is arranged to transmit ions having a single or specific mass to charge ratio or a relatively narrow range of mass to charge ratios.

The mass filter preferably comprises either a quadrupole rod set mass filter. However, according to other embodiments the mass filter may comprise a Time of Flight mass analyser, a Wein filter or a magnetic sector mass analyser.

The mass spectrometer may include a collision or fragmentation cell. According to an embodiment the collision or fragmentation cell is preferably arranged upstream of any means for converting a continuous ion beam into a discontinuous ion beam. In one mode of operation at least some ions entering the collision or fragmentation cell are preferably caused to fragment into a plurality of fragment or daughter ions.

BRIEF DESCRIPTION OF THE DRAWINGS

Various embodiments of the present invention together with an arrangement given for illustrative purposes only will now be described, by way of example only, and with reference to the accompanying drawings in which.

DETAILED DESCRIPTION OF THE PREFERRED EMBODIMENTS

Figure 1A:
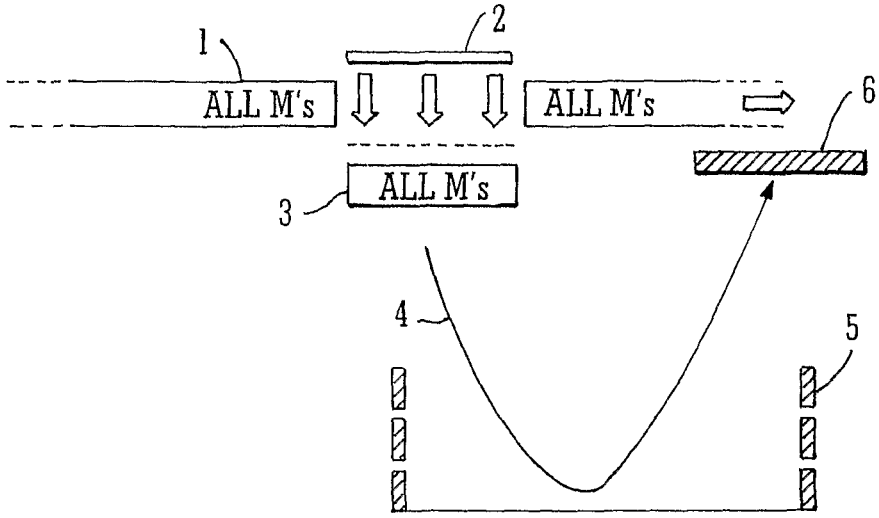
FIG. 1A PRIOR ART
FIG. 1A shows a conventional orthogonal acceleration Time of Flight mass analyser wherein a continuous ion beam is periodically sampled by energising an orthogonal acceleration electrode and FIG. 1B shows the duty cycle as a function of mass to charge ratio for a conventional orthogonal acceleration Time of Flight mass analyser and a plot of an enhanced duty cycle as a function of mass to charge ratio which may be obtained according to a known method of enhancing the duty cycle of a Time of Flight mass analyser.

A known orthogonal acceleration Time of Flight mass analyser is shown in FIG. 1A. The orthogonal acceleration Time of Flight mass analyser comprises an orthogonal acceleration electrode 2, a reflectron 5 and an ion detector 6. A continuous beam of ions is transmitted to the mass analyser and the mass analyser is arranged to sample the continuous beam of ions by periodically accelerating ions out from an acceleration region which is arranged adjacent to the orthogonal acceleration electrode 2. The ions which are orthogonally accelerated pass into a drift region of the mass analyser. According to the known arrangement a fraction or proportion 3 of the continuous ion beam is sampled or orthogonally accelerated into the drift region of the mass analyser when the orthogonal acceleration or pusher electrode 2 is energised. The ions 4 which are orthogonally accelerated into the drift region are then reflected by a reflectron 5 and are directed back towards the ion detector 6. The ions follow a trajectory as indicated by arrow 4.

Once a packet of ions has been orthogonally accelerated into the drift region of the mass analyser an orthogonal acceleration voltage is not applied again to the orthogonal acceleration electrode 2 until the last of ions which have been orthogonally accelerated into the drift region arrive at the ion detector 6 and are detected. The last ions to arrive at the ion detector 6 are those having the highest mass to charge ratio. The requirement of waiting until the last ions have arrived at the ion detector 6 before energising the orthogonal acceleration electrode 2 again is necessary in order to prevent ions having a relatively high mass to charge ratio which were orthogonally accelerated by a first pulse and which have not yet reached the ion detector 6 from being overtaken by ions having a relatively low mass to charge ratio which were orthogonally accelerated by a second subsequent pulse. The maximum sampling duty cycle DC of ions having a particular mass to charge ratio is determined by the geometry of the Time of Flight mass analyser and is typically between 10% and 25%. The duty cycle can be calculated using the following relation:

$$DC = \frac{w}{L}\sqrt{\frac{m/z}{(m/z)_{max}}} \quad (2)$$

wherein w is length of the orthogonal acceleration or pusher region adjacent the orthogonal acceleration electrode, L is the separation between the centre of the orthogonal acceleration or pusher electrode and the centre of the ion detector and $(m/z)_{max}$ is the maximum mass to charge ratio of ions of interest.

The duty cycle is therefore lowest at relatively low mass to charge ratios and is highest at relatively high mass to charge ratios. This is demonstrated by the unbroken line shown in FIG. 1B which illustrates the duty cycle for the Case where w/L=0.22.

As previously mentioned, it is known to attempt to maximise the duty cycle for ions having a relatively narrow range of mass to charge ratios. The known method of duty cycle enhancement involves trapping ions in an ion trap which is arranged upstream of the Time of Flight mass analyser. Ions are released in a pulse from the ion trap and an orthogonal acceleration pulse is applied to the orthogonal acceleration electrode 2 after a predetermined delay. The delay time is set so as to correspond with the arrival of particular ions of interest at the orthogonal acceleration region adjacent which is immediately adjacent the orthogonal acceleration or pusher electrode 2.

Figure 1B:
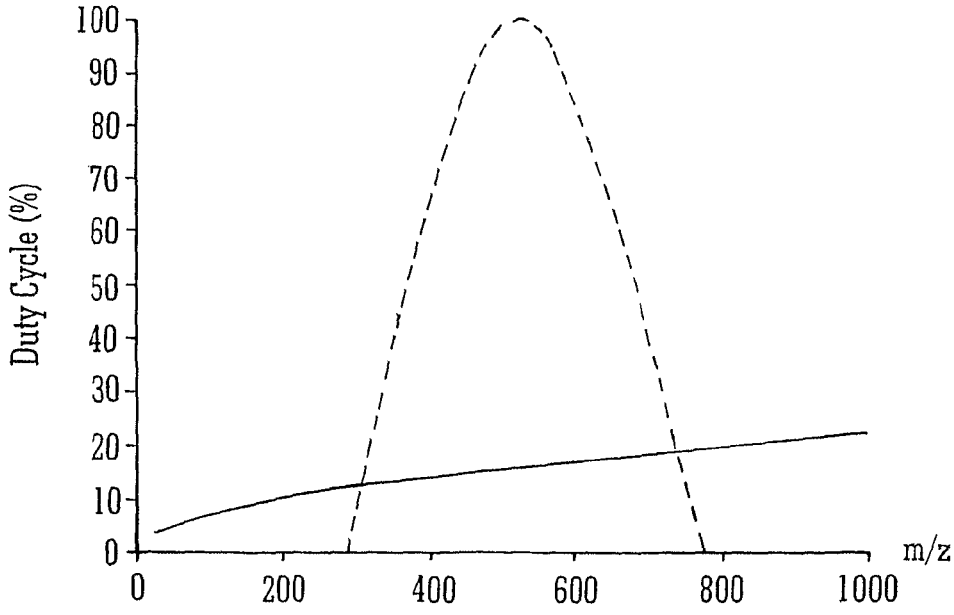
FIG. 1B PRIOR ART

Another method of duty cycle enhancement is known wherein a travelling wave ion guide is provided upstream of an orthogonal acceleration Time of Flight mass analyser. The travelling wave ion guide is used to partition a continuous stream of ions which is received at the entrance to the travelling wave ion guide. Packets of ions are periodically released from the exit region of the ion guide as an axial potential well reaches the end of the ion guide. The energisation of the orthogonal acceleration electrode is synchronised with each packet of ions which is released or ejected from the travelling wave ion guide. The dashed line in FIG. 1B shows how the Duty Cycle may be enhanced when an orthogonal acceleration pulse is synchronised to correspond with the arrival of ions having a mass to charge ratio of 500 Da at the orthogonal acceleration region of the Time of Flight mass analyser.

Figure 2A:
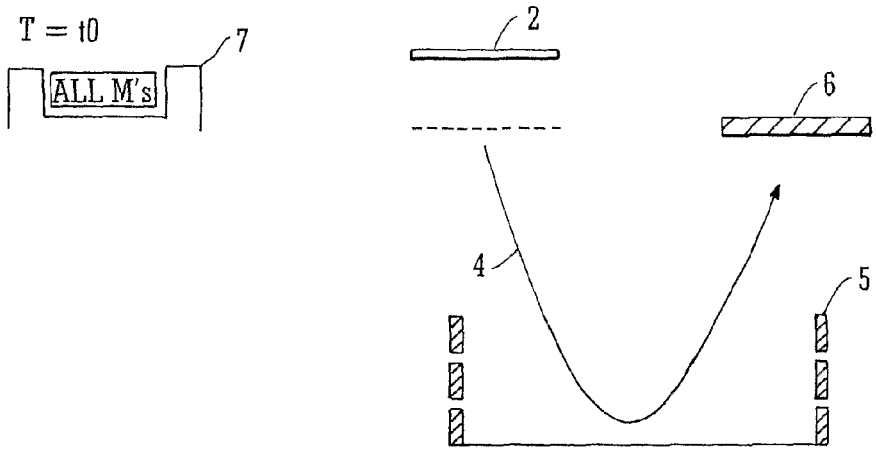
FIG. 2A shows an orthogonal acceleration Time of Flight mass analyser according an embodiment of the present invention wherein ions are initially trapped in an ion trap.

The operation of a mass spectrometer according to a preferred embodiment of the present invention will now be described with reference to FIGS. 2A-2E. The mass spectrometer comprises an orthogonal acceleration Time of Flight mass analyser and an ion storage device or an ion partitioning device 7 which is preferably arranged upstream of the Time of Flight mass analyser as shown in FIG. 2A. The ion storage or ion partitioning device 7 may comprise according to an embodiment either an ion trap or alternatively a travelling wave ion guide. The orthogonal acceleration Time of Flight mass analyser preferably comprises an orthogonal acceleration region which is preferably located adjacent an orthogonal acceleration electrode or a pusher and/or puller electrode 2. The Time of Flight mass analyser preferably further comprises a reflectron 5 and an ion detector 6. An arrow 4 indicates the approximate path that ions follow once they have been accelerated into the drift region of the orthogonal acceleration Time of Flight mass analyser.

Figure 2B:
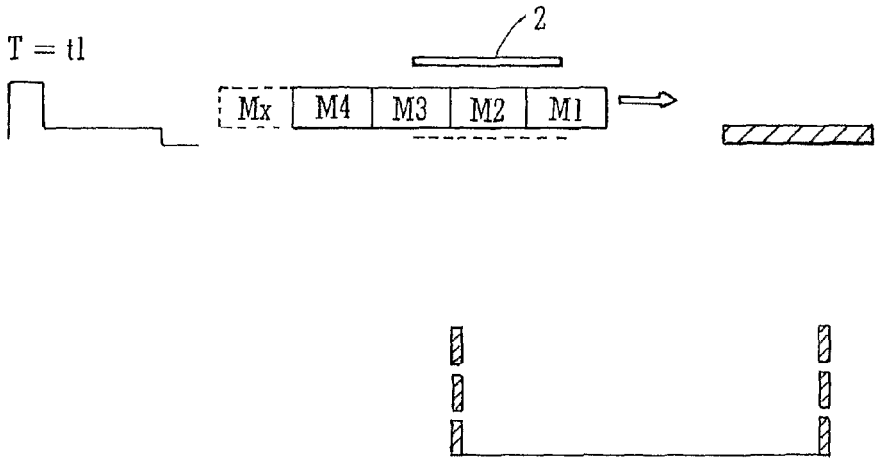
FIG. 2B shows a first packet of ions which has been released from the ion trap and which becomes spatially dispersed.

A packet of ions is preferably released from the ion guide or the ion trap 7 arranged upstream of the orthogonal acceleration Time of Flight mass analyser. The ions which are released preferably travel towards the orthogonal acceleration region of the Time of Flight mass analyser. The ions preferably become spatially and/or temporally dispersed by the time that at least some ions arrive at or approach the orthogonal acceleration region adjacent the orthogonal acceleration or pusher and/or puller electrode 2. This is illustrated in FIG. 2B. Ions having a relatively low mass to charge ratio M1 will reach the orthogonal acceleration or pusher and/or puller electrode 2 prior to other ions which have a relatively high mass to charge ratio.

Figure 2C:
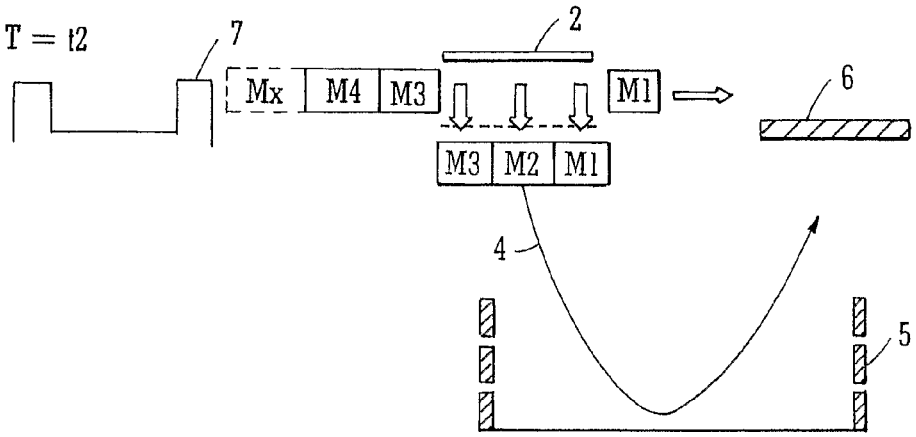
FIG. 2C shows an orthogonal acceleration electrode being energised for a first time so that a first group of ions are orthogonally accelerated into the drift region of the Time of Flight mass analyser.

As shown in FIG. 2C, the orthogonal acceleration or pusher and/or puller electrode 2 is preferably energised a first time so as to orthogonally accelerate some ions into the drift or time of flight region of the Time of Flight mass analyser. The ions are orthogonally accelerated at a predetermined time t2 after ions were first released from the upstream ion guide or ion trap 7. The arrival time of an ion at the orthogonal acceleration region adjacent the orthogonal acceleration or pusher and/or puller electrode 2 is preferably dependent upon the mass to charge ratio of the ion. If an appropriate time delay is set between the release of ions from the ion guide or ion trap 7 and the subsequent energisation of the orthogonal acceleration or pusher and/or puller electrode 2 then substantially 100% of ions having a particular mass to charge ratio (M2) will be orthogonally accelerated into the drift region of the Time of Flight mass analyser.

A proportion of other ions having mass to charge ratios (M1,M3) which are close to the mass to charge ratio of the ion of interest (M2) will also be present in the orthogonal acceleration region or adjacent the orthogonal acceleration electrode or pusher and/or puller electrode 2 when the orthogonal acceleration electrode or pusher and/or puller electrode 2 is energised. Accordingly, ions having mass to charge ratios (M1,M3) which are close to the mass to charge ratio (M2) of the ions of interest will also exhibit an improvement in duty cycle but the duty cycle will be less than 100%.

According to an important aspect of the preferred embodiment the orthogonal acceleration electrode or pusher and/or puller electrode 2 is preferably energised at least a second time before a second or subsequent packet of ions is released from the ion guide or ion trap 7. This is in contrast to the known Time of Flight mass spectrometer wherein the orthogonal acceleration electrode is only energised once per release of ions from an ion trap arranged upstream of the Time of Flight mass analyser.

Figure 2D:
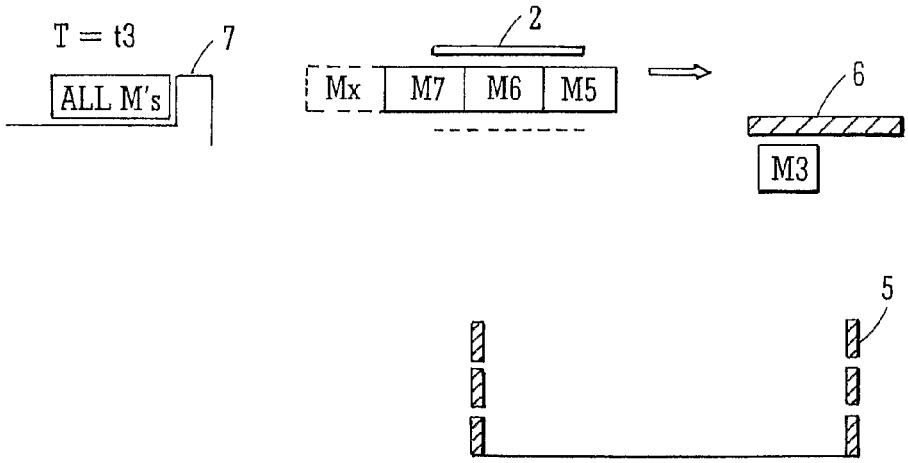
FIG. 2D shows other ions continuing to arrive at an orthogonal acceleration region adjacent the orthogonal acceleration electrode.
Figure 2E:
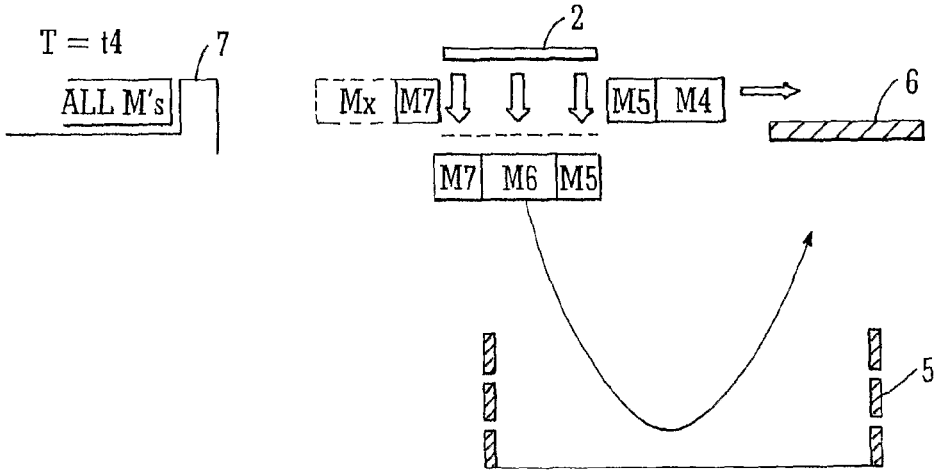
FIG. 2E shows the orthogonal acceleration electrode being energised for a second time prior to a second packet of ions being released from the ion trap.

According to the preferred embodiment after a first pulse of ions has been orthogonally accelerated by the first energisation of the orthogonal acceleration electrode or pusher and/or puller electrode 2 the voltage applied to the orthogonal acceleration electrode or pusher and/or puller electrode 2 is preferably reset to zero. Further ions preferably continue to approach the orthogonal acceleration region adjacent the orthogonal acceleration electrode or pusher and/or puller electrode 2. Once the orthogonal acceleration region has refilled with or admitted ions having relatively higher mass to charge ratios (as shown in FIG. 2D) then the orthogonal acceleration electrode or pusher and/or puller electrode 2 is preferably energised a second time at a time t4 shown in FIG. 2E. FIG. 2E shows how substantially all ions having a mass to charge ratio of M6 and some ions having a mass to charge ratio of either M5 or M7 are orthogonally accelerated into the drift region of the Time of Flight mass analyser according to the preferred embodiment wherein M7>M6>M5.

The process of energising the orthogonal acceleration electrode or pusher and/or puller electrode 2 may be repeated a third and subsequent times prior to releasing a second or subsequent pulse of ions from the ion guide or ion trap 7. The orthogonal acceleration electrode or pusher and/or puller electrode 2 is preferably repeatedly re-energised until ions having the highest mass to charge ratio of interest which were contained in the original or first packet of ions which was released from the ion guide or ion trap 7 has passed to the orthogonal acceleration region adjacent the orthogonal acceleration or pusher and/or puller electrode 2.

According to an embodiment the number of repeat pulses or energisations of the orthogonal acceleration electrode or pusher and/or puller electrode 2 per release of a packet of ions from the ion guide or ion trap 7 may be partly dependent upon how quickly the acceleration voltage can be reset to zero after a group of ions has exited the orthogonal acceleration region. It may also be dependent upon the mass to charge ratio range of ions released in the initial packet of ions from the ion trap 7.

Figure 3:
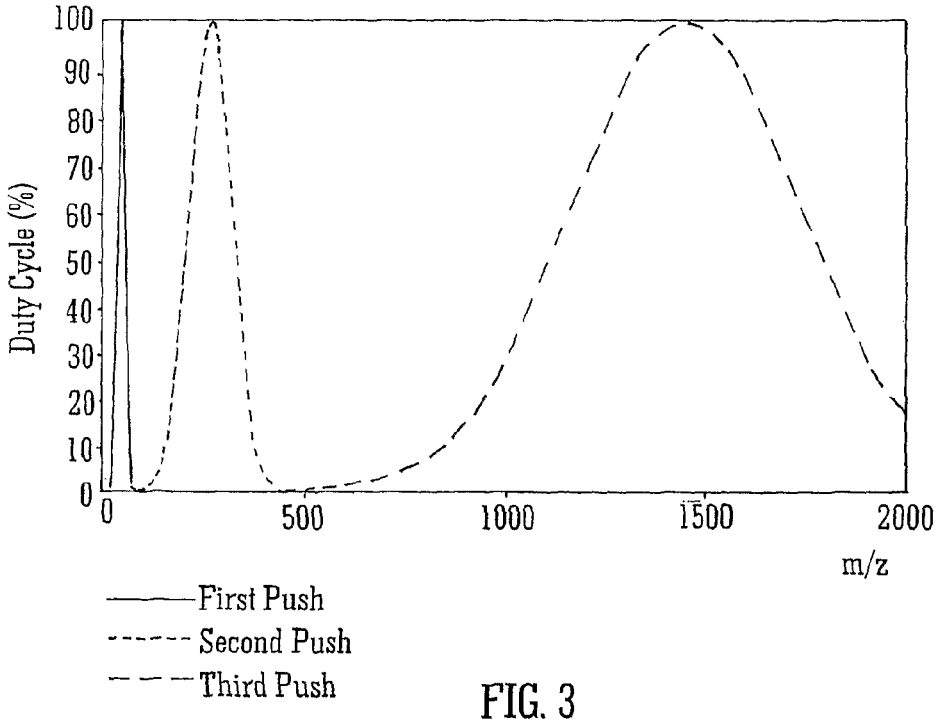
FIG. 3 illustrates the enhancement in duty cycle which may obtained according to an embodiment of the present invention by energising the orthogonal acceleration electrode of a Time of Flight mass analyser at three different delays times after the release of a first packet of ions from an ion trap and prior to the release of a second packet of ions from the ion trap.

FIG. 3 shows a plot of the theoretical duty cycle as a function of mass to charge ratio which may be achieved according to an embodiment of the present invention by energising the orthogonal acceleration electrode or pusher and/or puller electrode 2 three times after each release of an ion packet from an upstream ion trap 7 and prior to the release of subsequent packet of ions from the ion trap 7. The timing of the energisation of the orthogonal acceleration electrode or pusher and/or puller electrode 2 was set so that ions having mass to charge ratios of 50, 270 and 1454 Da were optimised to be orthogonally accelerated into the drift region of the Time of Flight mass analyser. The full width at half maximum (FWHM) of an enhanced duty cycle window at a mass to charge ratio (m/z) for each selected ion is governed by the following relation which is relevant to the apparatus used for these experiments:

$$FWHM = \frac{m/z}{2.2} \tag{8}$$

It is apparent that the mass to charge ratio range over which a duty cycle gain is achieved is relatively narrow at relatively low mass to charge ratios but is relatively wide at relatively high mass to charge ratios.

The range of mass to charge ratios over which a duty cycle gain is achieved may be widened but at the expense of the maximum duty cycle that can be obtained.

The time delay between the release of a packet of ions from an upstream ion trap 7 or alternatively from a travelling wave ion guide to the energisation of the orthogonal acceleration electrode or pusher and/or puller electrode 2 may be varied from release to release. According to an embodiment the various delay times may be incremented by pre-determined amounts for a pre-determined number of releases of packets of ions. This enables multiple enhanced duty cycle windows to be interleaved to give an overall averaged duty cycle. The number of enhanced duty cycle windows that may be averaged in this manner may vary from two to any number.

The time delay between orthogonal pushes or energisations of the orthogonal acceleration or pusher and/or puller electrode 2 may be varied in different ways which may have the effect of altering the final averaged duty cycle distribution. For example, it may be varied linearly with mass or mass to charge ratio or it may be varied linearly with time. Other embodiments are contemplated wherein the time delay may be varied or exponentially with mass or mass to charge ratio or exponentially with time during a cycle. For example, ions may according to an embodiment be orthogonally accelerated after time delays of 2.5 μs, 5 μs, 10 μs and 20 μs.

Figure 4A:
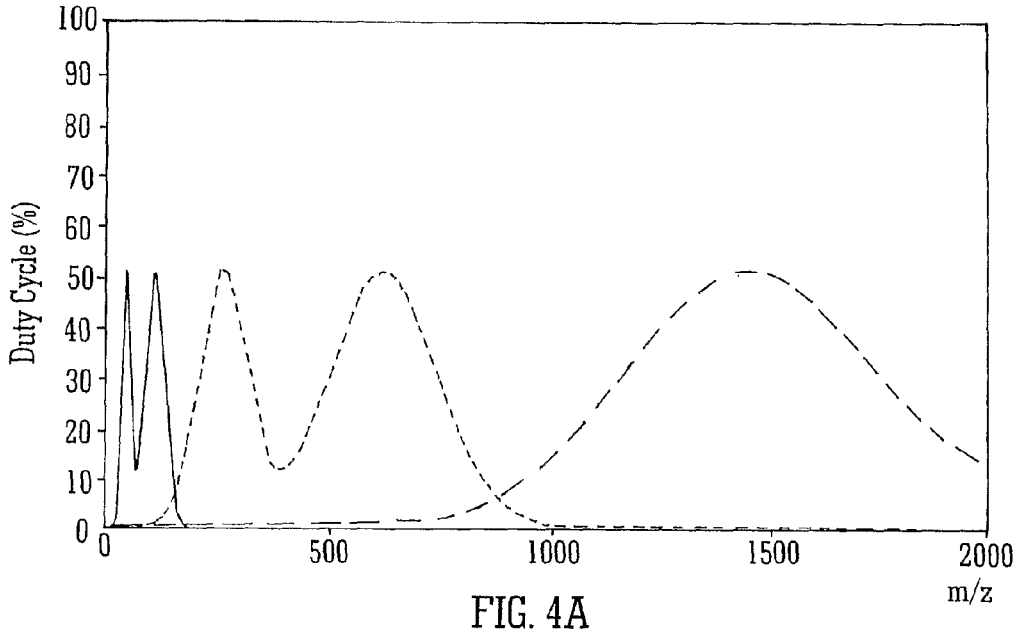
FIG. 4A is a plot of the duty cycle according to an embodiment wherein two cycles are performed and the orthogonal acceleration electrode is energised at three different delay times in each cycle and wherein the delay times are increased from one cycle to the next.

FIG. 4A shows the duty cycle for two interleaved enhanced duty cycle windows. According to this embodiment, in a first cycle a first pulse or packet of ions was released from an ion trap and then the orthogonal acceleration electrode was energised three times. In a second cycle a second pulse or packet of ions was released from the ion trap and the orthogonal acceleration electrode was then energised a further three times. The delay times at which the orthogonal acceleration electrode was energised in the second cycle were arranged to be different from the delay times in the first cycle.

Figure 4B:
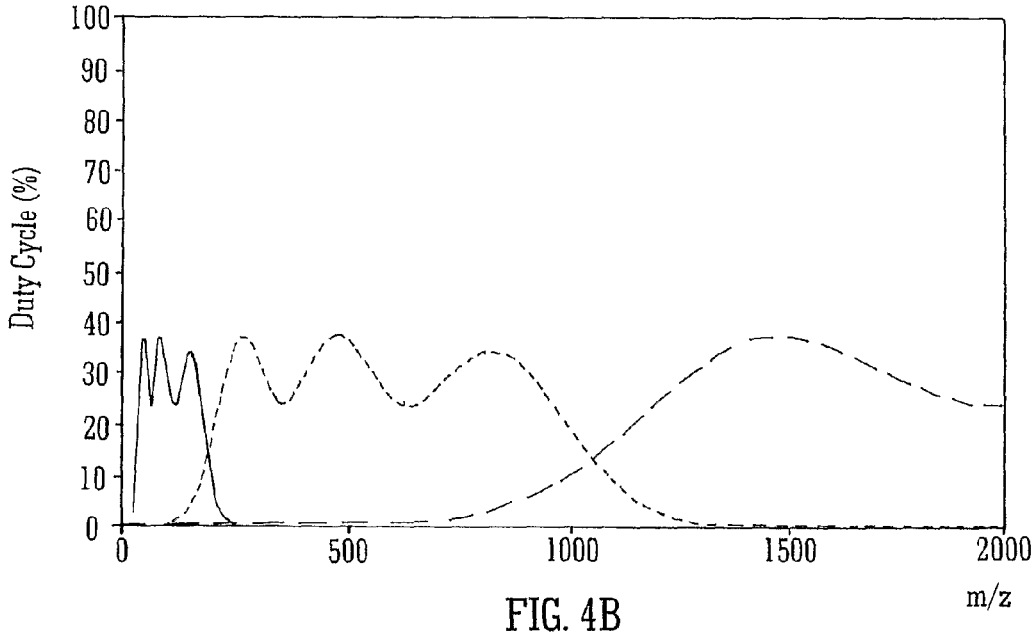
FIG. 4B is a plot of the duty cycle according to an embodiment wherein three cycles are performed and the orthogonal acceleration electrode is energised at three different delay times in each cycle and Wherein the delay times are increased from one cycle to the next.

FIG. 4B shows the duty cycle for three interleaved enhanced duty cycle windows. According to this embodiment, in a first cycle a first pulse or packet of ions was released from an ion trap and then the orthogonal acceleration electrode was energised three times. In a second cycle a second pulse or packet of ions was released from the ion trap and the orthogonal acceleration electrode was then energised a further three times. In a third cycle a third pulse or packet of ions was released from the ion trap and the orthogonal acceleration electrode was then energised a further three times. The delay times at which the orthogonal acceleration electrode were energised in the first, second and third cycles were arranged to be different.

Figure 4C:
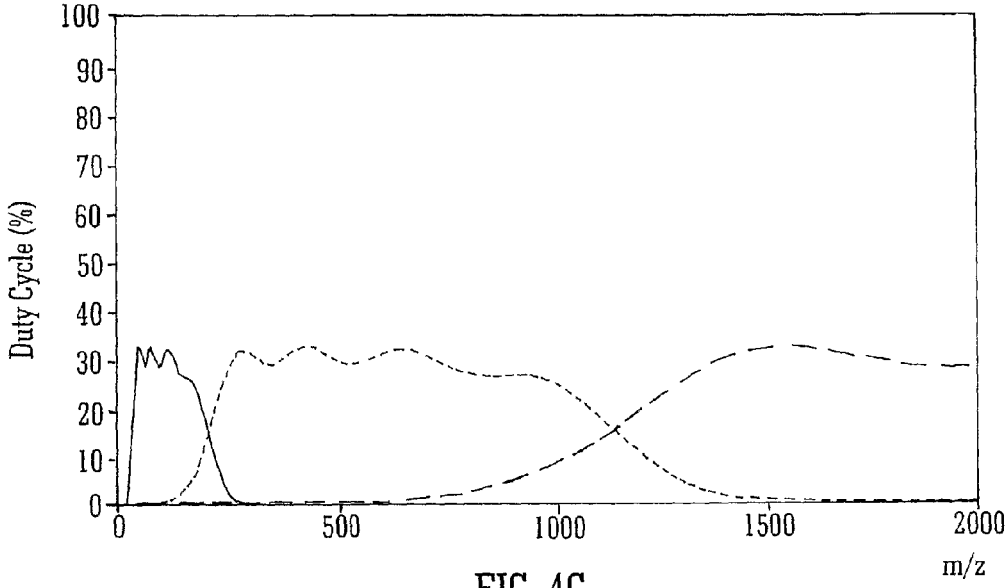
FIG. 4C is a plot of the duty cycle according to an embodiment wherein four cycles are performed and the orthogonal acceleration electrode is energised at three different delay times in each cycle and wherein the delay times are increased from one cycle to the next.

FIG. 4C shows the duty cycle for four interleaved enhanced duty cycle windows. According to this embodiment, in a first cycle a first pulse or packet of ions was released from an ion trap and then the orthogonal acceleration electrode was energised three times. In a second cycle a second pulse or packet of ions was released from the ion trap and the orthogonal acceleration electrode was then energised a further three times. In a third cycle a third pulse or packet of ions was released from the ion trap and the orthogonal acceleration electrode was then energised a further three times. In a fourth cycle a fourth pulse or packet of ions was released from the ion trap and the orthogonal acceleration electrode was then energised a further three times. The delay times at which the orthogonal acceleration electrode were energised in the first, second, third and fourth cycles were arranged to be different.

Figure 4D:
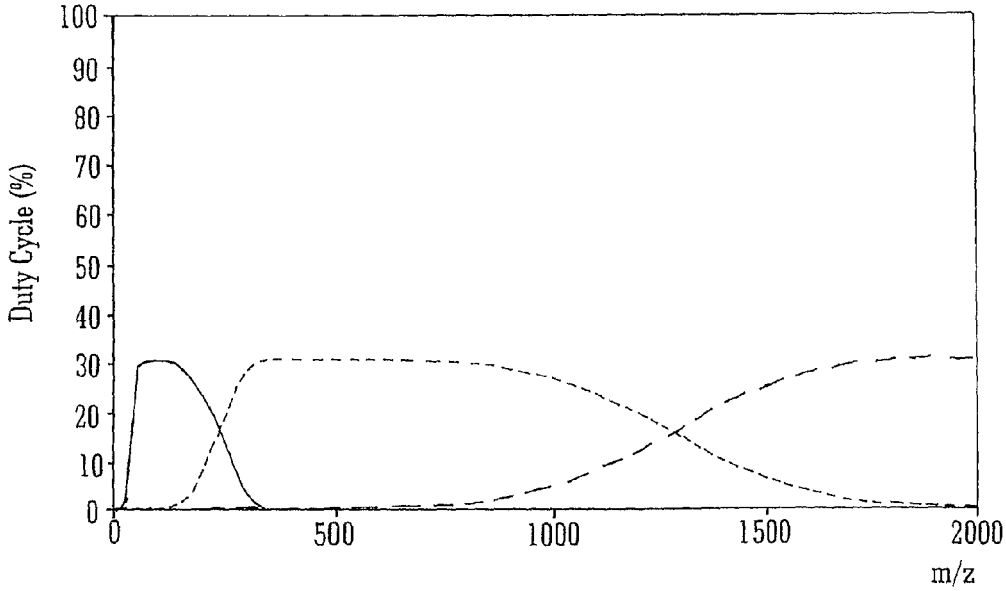
FIG. 4D is a plot of the duty cycle according to an embodiment wherein ten cycles are performed and the orthogonal acceleration electrode is energised at three different delay times in each cycle and wherein the delay times are increased from one cycle to the next.

FIG. 4D shows the duty cycle for ten interleaved enhanced duty cycle windows. According to this embodiment, in a first cycle a first pulse or packet of ions was released from an ion trap and then the orthogonal acceleration electrode was energised three times. In a second cycle a second pulse or packet of ions was released from the ion trap and the orthogonal acceleration electrode was then energised a further three times. In a third cycle a third pulse or packet of ions was released from the ion trap and the orthogonal acceleration electrode was then energised a further three times. In a fourth cycle a fourth pulse or packet of ions was released from the ion trap and the orthogonal acceleration electrode was then energised a further three times. In a fifth cycle a fifth pulse or packet of ions was released from the ion trap and the orthogonal acceleration electrode was then energised a further three times. In a sixth cycle a sixth pulse or packet of ions was released from the ion trap and the orthogonal acceleration electrode was then energised a further three times. In a seventh cycle a seventh pulse or packet of ions was released from the ion trap and the orthogonal acceleration electrode was then energised a further three times. In an eighth cycle an eighth pulse or packet of ions was released from the ion trap and the orthogonal acceleration electrode was then energised a further three times. In a ninth cycle a ninth pulse or packet of ions was released from the ion trap and the orthogonal acceleration electrode was then energised a further three times. In a tenth cycle a tenth pulse or packet of ions was released from the ion trap and the orthogonal acceleration electrode was then energised a further three times. The delay times at which the orthogonal acceleration electrode was energised in the first, second, third, fourth, fifth, sixth, seventh, eighth, ninth and tenth cycles were arranged to be different.

In FIGS. 4A-4D the continuous line shows the duty cycle due to energising the orthogonal acceleration electrode a first time and at different delay times in each cycle. The short dashed line shows the duty cycle due to energising the orthogonal acceleration electrode a second time and at different delay times in each cycle. The long dashed line shows the duty cycle due to energising the orthogonal acceleration electrode a third time and at different delay times.

Figure 4E:
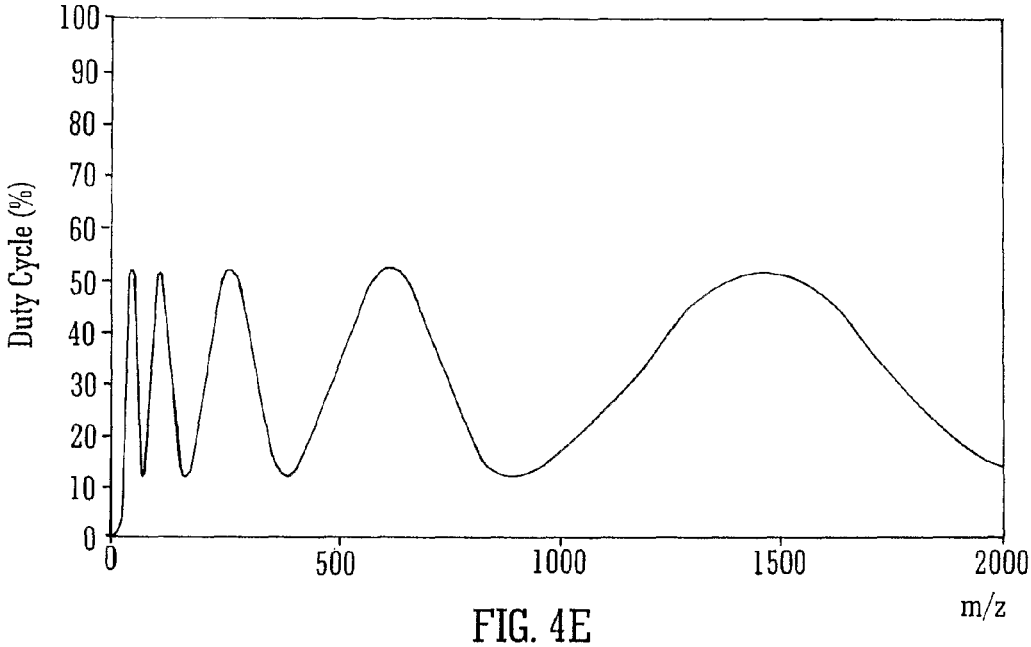
FIG. 4E illustrates the resulting duty cycle corresponding to the embodiment shown in FIG. 4A wherein two cycles were performed.
Figure 4F:
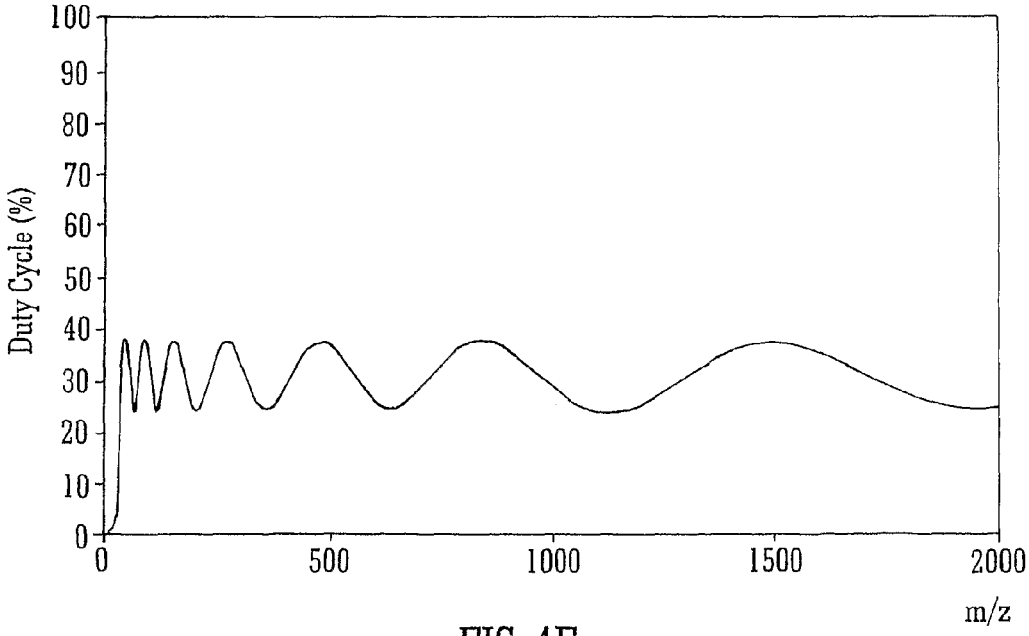
FIG. 4F illustrates the resulting duty cycle corresponding to the embodiment shown in FIG. 4B wherein three cycles were performed.
Figure 4G:
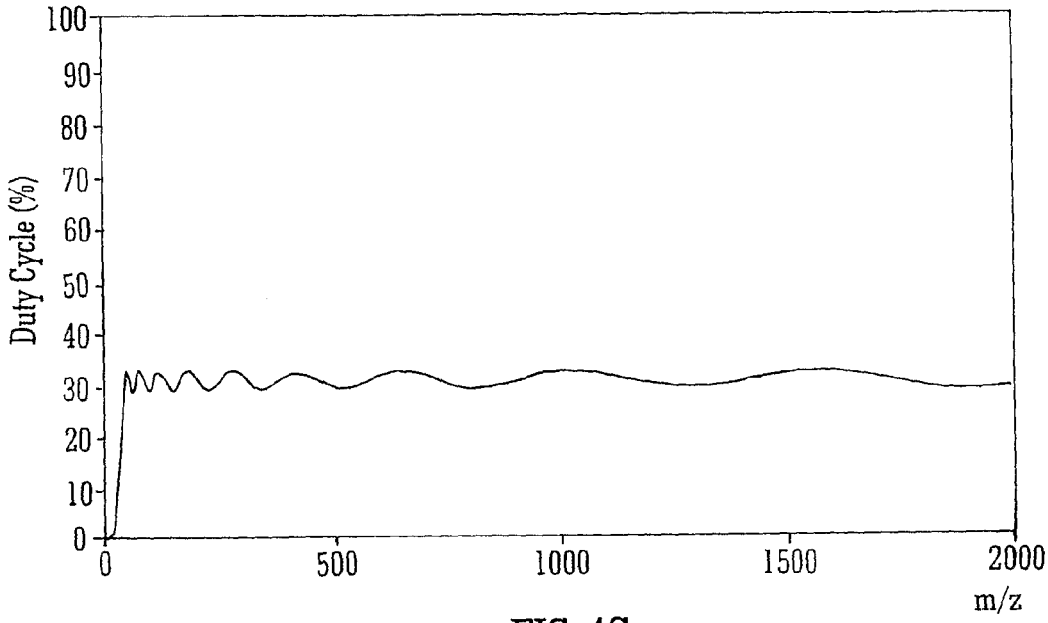
FIG. 4G illustrates the resulting duty cycle corresponding to the embodiment shown in FIG. 4C wherein four cycles were performed and FIG. 4H illustrates the resulting duty cycle corresponding to the embodiment shown in FIG. 4D wherein ten cycles were performed.
Figure 4H:
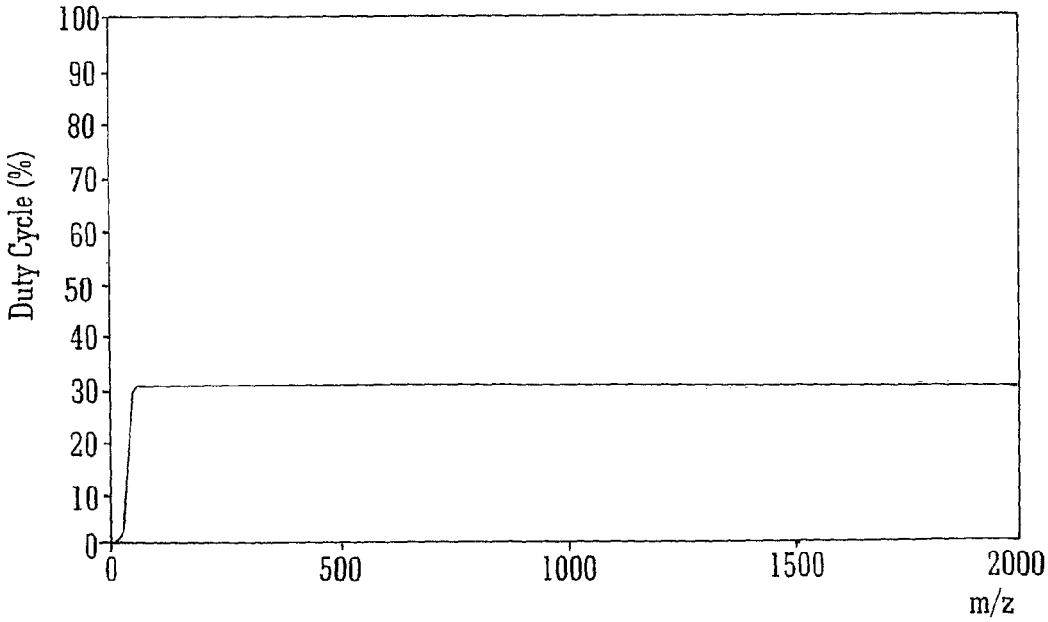

FIG. 4E shows the total averaged duty cycle when the contributions from two cycles of three pushes per cycle were combined. FIG. 4F shows the total averaged duty cycle when the contributions from three cycles of three pushes per cycle were combined. FIG. 4G shows the total averaged duty cycle when the contributions from four cycles of three pushes per cycle were combined. FIG. 4H shows the total averaged duty cycle when the contributions from ten cycles of three pushes per cycle were combined.

In these examples the first push has been interleaved between 50 and 270 Da, the second push has been interleaved between 270 and 1450 Da and the third push has been interleaved between 1450 and 7800 Da. Increasing the number of pushes has the effect of smoothing out the duty cycle distribution. It can be seen from FIG. 4H that interleaving ten cycles gives a constant 30% duty cycle from approximately 50 Da upwards.

Figure 5:
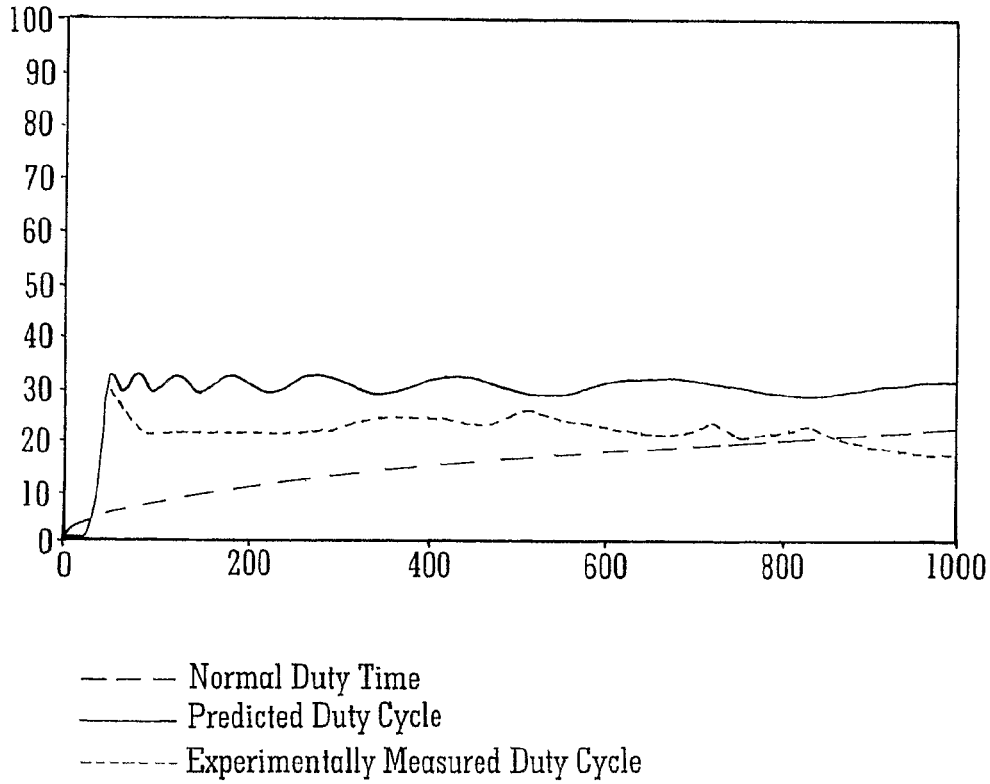
FIG. 5 shows: (i) the duty cycle of an orthogonal acceleration Time of Flight mass spectrometer operated in a conventional manner wherein a continuous ion beam is periodically sampled; (ii) a duty cycle according to an embodiment of the present invention which was theoretically predicted; (iii) and a duty cycle according to an embodiment of the present invention as was obtained experimentally.

FIG. 5 illustrates the normal duty cycle of an orthogonal acceleration Time of Flight mass analyser when sampling a continuous ion beam in a conventional manner. FIG. 5 also shows the theoretical enhancement in duty cycle which may be obtained according to an embodiment of the present invention together with an experimentally obtained enhancement in duty cycle. The theoretical and experimental enhancements in duty cycle relate to an embodiment wherein three orthogonal acceleration pulses were applied to the orthogonal acceleration electrode or pusher and/or puller electrode 2 after each packet of ions was released from the ion trap 7. Four different enhanced duty cycle windows were interleaved. FIG. 5 also shows preliminary experimental data which confirms that an improvement in duty cycle to a substantially constant value may be achieved over a wide mass to charge ratio range.

Figure 6A:
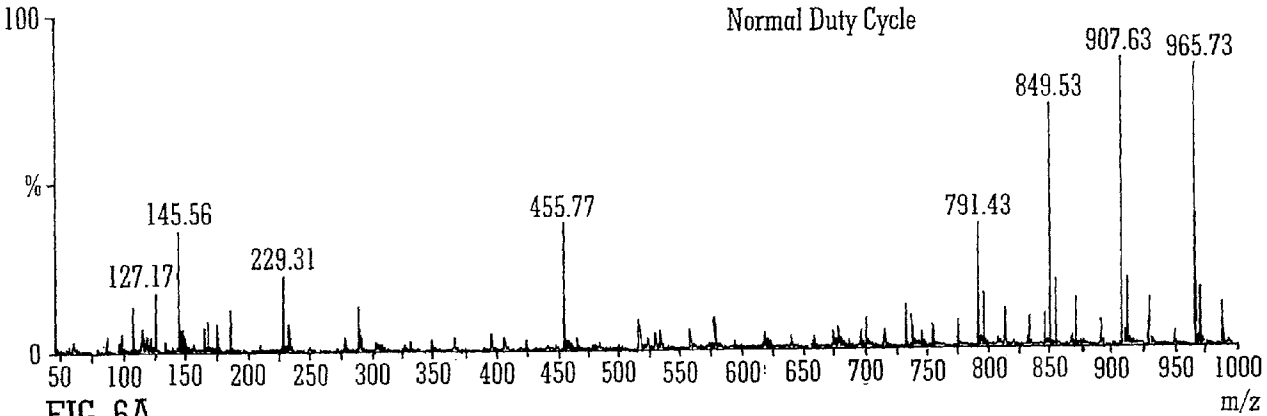
FIG. 6A shows a mass spectrum obtained by operating an orthogonal acceleration Time of Flight mass analyser in a conventional manner wherein a continuous ion beam was periodically sampled and FIG. 6B shows a mass spectrum obtained according to an embodiment of the present invention wherein the duty cycle was enhanced across a large proportion of the mass spectrum.
Figure 6B:
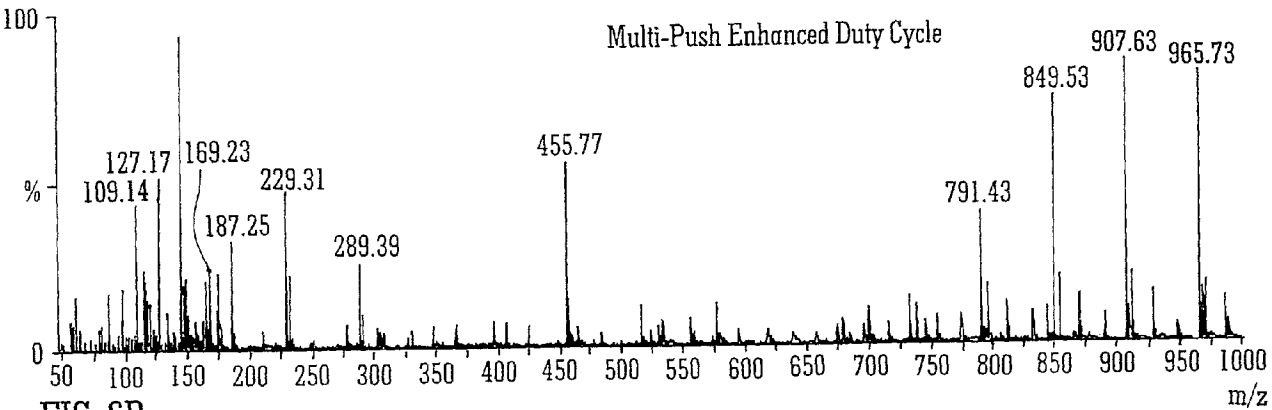

FIG. 6A shows a mass spectrum obtained by operating an orthogonal acceleration Time of Flight mass spectrometer in a conventional manner. FIG. 6B shows a corresponding mass spectrum obtained according to a preferred embodiment by energising the pusher electrode 2 of a Time of Flight mass analyser multiple times after each release of ions from an ion trap 7 arranged upstream of the Time of Flight mass analyser. The enhanced duty cycle windows were interleaved. The two mass spectra are plotted with the same vertical or intensity scale. The significant improvement in duty cycle particularly at relatively low mass to charge ratio has the effect of significantly increasing the intensity of the ion signal for these ions without sacrificing sensitivity for ions having relatively high mass to charge ratios.

Further embodiments are contemplated wherein the pusher electrode 2 may be energised whilst ions from a preceding push are still travelling towards the ion detector 6. The ions in a preceding push are predominantly lower in mass to charge ratio than those in the subsequent push and hence the ions from the subsequent push will not overtake the ions having relatively lower mass to charge ratios from the preceding push. Therefore, spectral overlap will not occur. Since a first Time of Flight measurement is still underway whilst a second Time of Flight measurement begins, two or more Time to Digital Converters ("TDCs") may be used. Alternatively, a single Time to Digital Converter may be used wherein a flag may be placed at a time which corresponds with the second pusher pulse. In this way the single Time to Digital Convertor may record both Time of Flight measurements.

With reference to FIG. 4H, although according to the preferred embodiment the delay times at which points the orthogonal acceleration electrode is energised after the release of pulses or packets of ions may be varied in, for example, ten subsequent cycles of operation so that a substantially constant overall duty cycle of approximately 30% may be obtained across substantially the whole of the mass to charge ratio of interest, other embodiments are contemplated wherein only ions having certain mass to charge to ratios may be of interest. According to this embodiment the delay times may not be varied from one cycle to the next. For example, with reference to FIG. 3, ions having a mass to charge ratio of 50, 270 and 1454 may be orthogonally accelerated with a duty cycle of 100%. Alternatively, the Time of Flight mass analyser may be operated in a mode wherein there are only two different delay times in subsequent cycles of operation. According to this embodiment the overall duty cycle would be similar to that shown in FIG. 4E. According to this embodiment five species of ions could, for example, be orthogonally accelerated with a duty cycle of 50%.

Similarly, according to the embodiment described above with reference to FIG. 4F seven species of ions could be orthogonally accelerated with a duty cycle of approximately 40%. It will be apparent that other variations are possible.

Embodiments of the present invention are contemplated wherein the Time of Flight mass analyser may be operated in a first mode of operation wherein a plurality of species of ions may be orthogonally accelerated with a high duty cycle (50-100%) and in a second mode of operation wherein substantially all ions above a low mass cut-off are orthogonally accelerated with a substantially constant and relatively high duty cycle of approximately 30%.

Although the present invention has been described with reference to the preferred embodiments, it will be understood by those skilled in the art that various changes in form and detail may be made without departing from the scope of the invention as set forth in the accompanying claims.

The invention claimed is:

1. A mass spectrometer comprising:

an ion guide comprising a plurality of electrodes;

a transient DC voltage source arranged and adapted to apply one or more transient DC voltages or potentials or one or more transient DC voltage or potential waveforms to at least some of the electrodes forming said ion guide in order to urge at least some ions along the axial length of said ion guide wherein, in use, a first pulse or packet of ions is released from said ion guide at a first release time T1; and a Time of Flight mass analyser arranged downstream of said ion guide and comprising an orthogonal acceleration electrode; a drift region and a control device which is arranged and adapted:

(i) to energise said orthogonal acceleration electrode a first time after a first delay time $\Delta t_{1-1}$ from said first release time T1 and prior to the release of a second pulse or packet of ions from said ion guide at a second release time T2; and (ii) to energise said orthogonal acceleration electrode at least a second subsequent time after a second delay time $\Delta t_{1-2}$ from said first release time T1 and prior to the release of the second pulse or packet of ions at the second release time T2.

2. A mass spectrometer as claimed in claim 1, wherein said control device is arranged and adapted to energise said orthogonal acceleration electrode a third time after a third delay time $\Delta t_{1-3}$ from said first release time T1 or a fourth time after a fourth delay time $\Delta t_{1-4}$ from said first release time T1 or a fifth time after a fifth delay time $\Delta t_{1-5}$ from said first release time T1 or a sixth time after a sixth delay time $\Delta t_{1-6}$ from said first release time T1 or a seventh time after a seventh delay time $\Delta t_{1-7}$ from said first release time T1 or an eighth time after an eighth delay time $\Delta t_{1-8}$ from said first release time T1 or a ninth time after a ninth delay time $\Delta t_{1-9}$ from said first release time T1 or a tenth time after a tenth delay time $\Delta t_{1-10}$ from said first release time T1 and prior to the release of a second pulse or packet of ions at a second release time T2.

3. A mass spectrometer as claimed in claim 1, wherein, in use, the second pulse or packet of ions is released at the second release time T2.

4. A mass spectrometer as claimed in claim 3, wherein said control device is arranged and adapted to energise said orthogonal acceleration electrode a first time after a first delay time $\Delta t_{2-1}$ from said second release time T2 and at least a second subsequent time after a second delay time $\Delta t_{2-2}$ from said second release time T2 and prior to the release of a third pulse or packet of ions at a third release time T3.

5. A mass spectrometer as claimed in claim 3, wherein, in use, a third pulse or packet of ions is released at a third release time T3.

6. A mass spectrometer as claimed in claim 1, wherein the first delay time or the second delay time is varied, increased, decreased or progressively changed after each release of a pulse or packet of ions.

7. A mass spectrometer as claimed in claim 1, wherein said Time of Flight mass analyser comprises an orthogonal acceleration Time of Flight mass analyser.

8. A mass spectrometer as claimed in claim 1, wherein one or more axial potential wells or one or more axial pseudo-potential wells are translated along the length of said ion guide and wherein when an axial potential well or an axial pseudo-potential well reaches the end or exit region of the ion guide ions contained within the axial potential well or the axial pseudo-potential well are arranged and adapted to be released or onwardly transmitted as a pulse or packet of ions.

9. A mass spectrometer as claimed in claim 1, wherein said ion guide comprises:

(i) a multipole rod set or a segmented multipole rod set;

(ii) an ion tunnel or ion funnel; or (iii) a stack or array of planar, plate or mesh electrodes.

10. A mass spectrometer as claimed in claim 9, wherein said ion tunnel or ion funnel comprises a plurality of electrodes or at least 2, 5, 10, 20, 30, 40, 50, 60, 70, 80, 90 or 100 electrodes having apertures through which ions are transmitted in use, wherein at least 5%, 10%, 15%, 20%, 25%, 30%, 35%, 40%, 45%, 50%, 55%, 60%, 65%, 70%, 75%, 80%, 85%, 90%, 95% or 100% of said electrodes have apertures which are of substantially the same size or area or which have apertures which become progressively larger or smaller in size or in area.

11. A mass spectrometer as claimed in claim 1, wherein said ion guide is arranged and adapted to receive a beam of ions and the application of one or more transient DC voltages or potentials or one or more transient DC voltage or potential waveforms to at least some of the electrodes forming said ion guide converts or partitions said beam of ions such that at least 1, 2, 3, 4, 5, 6, 7, 8, 9, 10, 11, 12, 13, 14, 15, 16, 17, 18, 19 or 20 separate groups or packets of ions are confined or isolated in said ion guide at any particular time, and wherein each group or packet of ions is separately confined or isolated in a separate axial potential well formed in said ion guide.

12. A mass spectrometer as claimed in claim 1, wherein said one or more transient DC voltages or potentials or one or more transient DC voltage or potential waveforms are translated along the length of the ion guide so that at least 1, 2, 3, 4, 5, 6, 7, 8, 9, 10, 11, 12, 13, 14, 15, 16, 17, 18, 19 or 20 separate groups or packets of ions are confined or isolated in said ion guide at any particular time and are axially translated along the length of said ion guide.

13. A mass spectrometer as claimed in claim 1, further comprising a collision, fragmentation or reaction device.

14. A mass spectrometer as claimed in claim 13, further comprising a control system arranged and adapted to switch or repeatedly switch the potential difference through which ions pass prior to entering said collision, fragmentation or reaction device between a relatively high fragmentation or reaction mode of operation wherein ions are substantially fragmented or reacted upon entering said collision, fragmentation or reaction device and a relatively low fragmentation or reaction mode of operation wherein substantially fewer ions are fragmented or reacted or wherein substantially no ions are fragmented or reacted upon entering said collision, fragmentation or reaction device.

15. A method of mass analysing ions according to their Time of Flight, comprising:

providing an ion guide comprising a plurality of electrodes;

applying one or more transient DC voltages or potentials or one or more transient DC voltage or potential waveforms to at least some of the electrodes forming said ion guide in order to urge at least some ions along at least 5%, 10%, 15%, 20%, 25%, 30%, 35%, 40%, 45%, 50%, 55%, 60%, 65%, 70%, 75%, 80%, 85%, 90%, 95% or 100% of the axial length of said ion guide;

providing an orthogonal acceleration electrode and a drift region downstream of said ion guide;

releasing a first pulse or packet of ions from said ion guide at a first release time T1;

energising said orthogonal acceleration electrode a first time after a first delay time $\Delta t_{1-1}$ from said first release time T1 and prior to the release of a second pulse or packet of ions from said ion guide at a second release time T2; and energising said orthogonal acceleration electrode at least a second subsequent time after a second delay time $\Delta t_{1-2}$ from said first release time T1 and prior to the release of the second pulse or packet of ions at the second release time T2.

16. A mass spectrometer as claimed in claim 1 wherein said transient DC voltage source is arranged and adapted to apply said one or more transient DC voltages or potentials or said one or more transient DC voltage or potential waveforms to the at least some of the electrodes forming said ion guide in order to urge the at least some ions along at least 5%, 10%, 15%, 20%, 25%, 30%, 35%, 40%, 45%, 50%, 55%, 60%, 65%, 70%, 75%, 80%, 85%, 90%, 95% or 100% of the axial length of said ion guide.

* * * * *